US007063013B2

(12) United States Patent
Jones et al.

(10) Patent No.: US 7,063,013 B2
(45) Date of Patent: Jun. 20, 2006

(54) CARD-FLIPPING DEVICE FOR USE IN CARD PRINTERS

(75) Inventors: Terrence K. Jones, Jamestown, RI (US); Raymond E. Maynard, Westerly, RI (US)

(73) Assignee: Zebra Atlantek, Inc., Warwick, RI (US)

( * ) Notice: Subject to any disclaimer, the term of this patent is extended or adjusted under 35 U.S.C. 154(b) by 0 days.

(21) Appl. No.: 10/807,657

(22) Filed: Mar. 24, 2004

(65) Prior Publication Data

US 2005/0053406 A1 Mar. 10, 2005

Related U.S. Application Data

(60) Provisional application No. 60/500,853, filed on Sep. 5, 2003.

(51) Int. Cl.
*B41F 17/08* (2006.01)

(52) U.S. Cl. ..... 101/40; 101/43; 101/44; 400/188; 400/521; 400/525; 347/218

(58) Field of Classification Search ..... 400/188, 400/521, 525; 101/190, 43, 44; 271/255, 271/184–186; 347/218; 399/364
See application file for complete search history.

(56) References Cited

U.S. PATENT DOCUMENTS 4,706,563 A * 11/1987 Kazui ..... 101/93.43
4,810,120 A * 3/1989 Narita et al. ..... 400/624
5,667,316 A 9/1997 Nardone et al.
5,673,076 A 9/1997 Nardone et al.
5,771,058 A 6/1998 Kobayashi
5,806,999 A * 9/1998 Kobayashi ..... 400/188
5,959,278 A * 9/1999 Kobayashi et al. ..... 235/449
5,966,160 A 10/1999 Nardone et al.
6,105,493 A 8/2000 Skubic et al.
6,249,303 B1 * 6/2001 Mochizuki et al. ..... 347/222
6,279,901 B1 8/2001 Fulmer
6,318,914 B1 11/2001 Cuo et al.
6,722,649 B1 * 4/2004 Yui ..... 271/184

FOREIGN PATENT DOCUMENTS

JP 56162185 12/1981
JP 05 233891 A 9/1993

OTHER PUBLICATIONS

International Search Report mailed Apr. 15, 2005, for PCT/US2004/027279.
International Search Report dated Jan. 31, 2005 for PCT/US2004/027279.

* cited by examiner

*Primary Examiner*—Andrew H. Hirshfeld
*Assistant Examiner*—Marissa Ferguson-Samreth
(74) *Attorney, Agent, or Firm*—Alston & Bird LLP

(57) ABSTRACT

A card-flipping device for a card printing apparatus is provided. The card-flipping device comprises a card-carrier unit for transporting the card in a vertical direction, a motor drive means for moving the unit in the vertical direction, and an actuator assembly including a rotatable cam arm for flipping the card over. The card-flipping device is particularly suitable for use in thermal dye printers that print images on card substrates such as driver's licenses, employee badges, student cards, and the like. After one surface of the card has been printed, the card is conveyed to the card-flipping device, where the card is flipped over so that the reverse, unprinted side of the card can be printed thereon.

31 Claims, 21 Drawing Sheets

CARD-FLIPPING DEVICE FOR USE IN CARD PRINTERS

CROSS-REFERENCE TO RELATED APPLICATIONS

This application claims the benefit of U.S. Provisional Patent Application No. 60/500,853 having a filing date of Sep. 5, 2003, the entire contents of which are hereby incorporated by reference.

BACKGROUND OF THE INVENTION

The present invention relates generally to a card printing apparatus for printing images on card substrates such as driver's licenses, employee badges, student cards, and the like. More particularly, the invention relates to a card-flipping device located in the printer and used for turning the card over so that both sides of the card can be printed with an image.

There are various known card printing apparatus which use a thermal printing process for producing colored images on card products. In general, these printing devices use a conventional thermal dye transfer printing method, wherein a thermal printing head thermally-transfers dyes from a dye ribbon to a surface of the card. The thermal dye ribbon contains thermal dye panels of different colors, typically cyan (C), magenta (M), yellow (Y), which are arranged in a repeating pattern. The dye ribbon may contain a black thermal dye panel (K) in some instances. The printer can produce a full-colored image on the card's surface by combining the three primary colors. Generally, the card must make three separate passes under the print head (i.e., one pass for each color) in order to produce this full-colored image.

Many conventional thermal printers are built compactly and contain only one printing station for printing images onto one surface of the card at a time. In many instances, however, it is necessary to print images on both sides of the card. Also, it often is desirable to laminate a protective film over the printed images. Thus, card-flippers or card-inverters have been developed. The card is printed on one surface and then conveyed to a card-flipper located within the printer, which rotates the card 180 degrees, so that the opposing surface of the card faces upwardly and can be printed thereon.

More particularly, card-turning devices, which use a set of rollers for conveying the card to the card-turning device, are known in the art. For example, Fulmer, U.S. Pat. No. 6,279,901 discloses a card inverter that includes a plate for supporting the card and a set of rollers for moving the card through the inverter and clamping the card. A stepper motor is used for powering a drive housing which rotates the card support plate so that the card is flipped 180 degrees. Thus, the inverter rotates the card about a central axis that bisects the card so the card plane is maintained in the first position and inverted position.

Kobayashi, U.S. Pat. No. 5,771,058 discloses a card-turning device for use with a card printer. The card-turning device comprises a rotary body rotatable on its own axis, which is provided with roller units, and a turning means for rotating the rotary body about the axis, and a card feeding means for driving at least one of the roller units. The card printer sends the card having one printed side into the card-turning device united with the card printer along a card feed passage by driving the card feed means. The card, which is fed into the card-turning device, is retained in position between the paired feed rollers. Then, the rotary body is rotated 180 degrees to turn the card upside down.

Cuo et al., U.S. Pat. No. 6,318,914 discloses a card-reversing device for use in card printers to perform printing on both sides of a card such as a credit card or telephone card. The card-reversing device includes a rotary means capable of retaining and turning the card upside down, a transmission unit that includes feeding and idle rollers capable of feeding the card, a lock means capable of controlling the rotation of the rotary means, and a friction medium that provides a rotation torque transporting from the transmission unit for the rotation of the rotary means. The '914 patent discloses that the card-turning device is capable of turning over a card without causing damage when the turnover operation is abnormally stopped.

A different card-flipping mechanism is described in Nardone et al., U.S. Pat. No. 5,966,160 ("the '160 patent"). In the thermal printer described in the '160 patent, the card is placed on a rod-driven carriage or truck so that the dye-receptive surface of the card, which is to be printed thereon, faces upwards. The card-carrying carriage moves forward on guide rails and transports the card to a position under the thermal print head. Typically, the card is passed under the print head three successive times in order that each primary color dye can be applied to the card, and a full-colored image can be generated. After the dye-receptive surface of the card has been printed with the dye or dyes needed to produce the image, the carriage moves the card to a card-flipping station. As the carriage enters the flip station, a block assembly with card-retaining channels grasps the side edges of the card. A motor-driven cam assembly drives the block assembly upwards so that the card is lifted from the carriage. When the block assembly reaches a pre-determined vertical position, a stepper motor automatically rotates the card-retaining channels by 180 degrees so that the card is flipped-over. The block assembly is then lowered back to its initial starting position, and the card is returned to the carriage with its unprinted surface facing upwards. Then, the carriage is driven again through the thermal printing station to produce a printed image on the reverse surface of the card. In this manner, both the front and back sides of the card are printed with images.

One disadvantage with the card-flipping system described in the '160 patent is that it uses two motors. The cam system which moves the block assembly between the lower and upper positions includes a drive motor. In addition, a separate stepping motor causes the card-retaining channels to rotate and turn the card over. It would be desirable to have a card-flipping system that uses only a single motor means. One object of the present invention is to provide a card-flipping device that includes a motorized means for lifting the card from the carriage, and a non-motorized means for flipping the card over.

Secondly, in the printer of the '160 Patent, the card is held in the card-retaining channels by means of a spring biasing means. Particularly, the '160 Patent discloses a system, where the outer retaining channel is mounted on a bearing and includes a spring so that the channel is biased inwardly. The channel engages and retains the card by this inward biasing force. Although these card-retaining channels are generally effective for holding the card in place, it would be desirable to have improved card-retaining guides that could grip cards of varying thickness. One object of the present invention is to provide a card-flipping device having improved card-retaining guides.

These and other objects, features, and advantages of this invention are evident from the following description and attached figures.

SUMMARY OF THE INVENTION

The present invention relates to a card-flipping device for use in card printers. The card-flipping device comprises a card-carrier unit for transporting the card in a vertical direction; a motor drive means for moving the unit in the vertical direction; and an actuator assembly including a rotatable cam arm for flipping the card over. The card-flipping device is particularly suitable for use in thermal dye printers that print images on card substrates such as driver's licenses, employee badges, student cards, and the like.

The card-flipping device comprises a card-carrier unit for transporting the card in a vertical direction. The unit is slidably attached to a vertical guide rail mounted to the frame of the printer, and the unit includes a pair of rotatable flip guides for holding the card. A motor drive means is coupled to the card-carrier unit for moving the unit in ascending and descending directions along the vertical guide rail. The card-flipping device further includes an actuator assembly, comprising: (i) a rotatable cam arm connected to the card-carrier unit, wherein the arm is capable of moving in ascending and descending directions with the card-carrier unit, (ii) a spring biasing means, (iii) a pair of sliding flip stop members, and (iv) a pair of sliding flip stop actuator levers connected to the flip stop members. The flip stop members are in a first position, wherein the ascending cam arm engages a flip stop member and a force exerted by a spring means causes the cam arm to rotate 180 degrees, thereby turning the card over. The descending cam arm of the card-carrier unit engages an actuator lever, thereby causing the flip stop members to slide from the first position to a second position.

BRIEF DESCRIPTION OF THE DRAWINGS

The novel features that are characteristic of the present invention are set forth in the appended claims. However, the preferred embodiments of the invention, together with further objects and attendant advantages, are best understood by reference to the following detailed description taken in connection with the accompanying drawings in which:

DETAILED DESCRIPTION OF THE PREFERRED EMBODIMENTS

Figure 1:
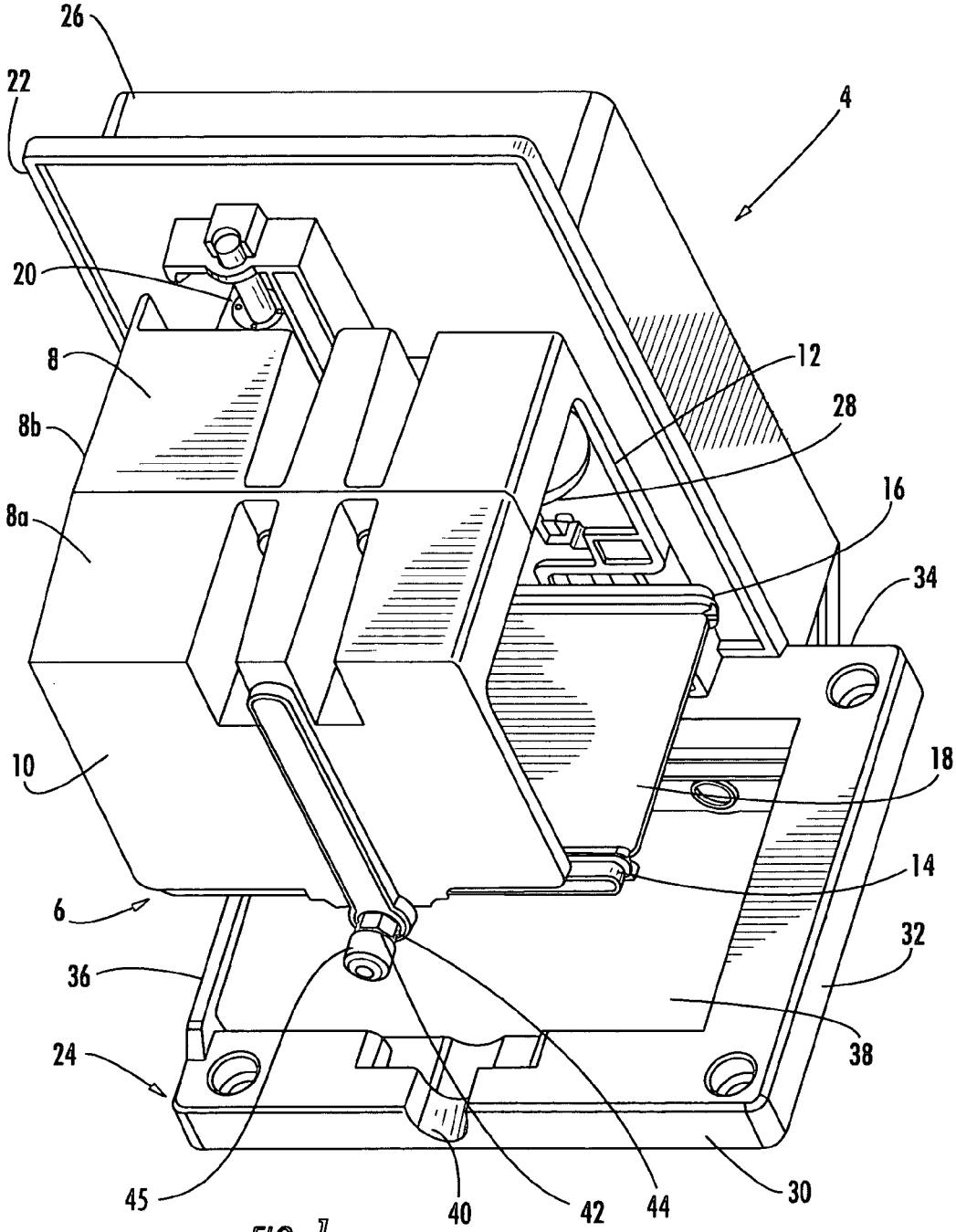
FIG. 1 is an isometric view of the card-flipping device of the present invention.

The card-flipping device of the present invention can be used in any suitable card printing apparatus and is particularly suitable for use in a thermal card printer.

The printing process can be used to produce a wide variety of card products, for example, passports, visas, driver's licenses, employee badges, student cards, credit cards, bank cards, security access cards, and the like. The card substrate has a front and back surface, and it is desirable often to print both surfaces of the card with the same or different indicia, for example, letters, numbers, symbols, photographs, and the like. A laminate film may be applied to each printed surface of the card in order to protect the printed images.

The card-flipping device of the present invention is particularly suitable for use in a thermal printer as described in Nardone et al., U.S. Pat. Nos. 5,673,076, 5,667,316, and 5,966,160 ("the Nardone Patents"), the disclosures of which are hereby incorporated by reference. These thermal card printers include a carriage or truck which receives the card so that the dye-receptive surface of the card, which is to be printed with the indicia, faces upwardly in the carriage. Then, the carriage is guided on a pair of rails and driven by a threaded rod to a thermal printing station. A motor causes the threaded rod to rotate and drive the carriage to the printing station.

At the thermal print station, the carriage moves under the thermal print head, and the thermal dyes are transferred to the card to produce a printed image on the card. In a three-pass printing operation, the card is passed under the print head three successive times to produce a full-colored image. In the first printing pass, a first dye (for example, cyan) is thermally transferred to the surface of the card. After the card has been printed with the first dye, the carriage holding the card moves rearward and returns the card to a print-starting position. The dye transfer ribbon is advanced to move the second dye panel (for example, magenta) into position, and the carriage again moves forward to a location under the print head. The second dye is transferred onto the card's surface at this point so that it overlays the printed pattern formed by the first dye. Then, the card is returned to the print-starting position. Finally, the dye transfer ribbon is advanced again to move the third dye panel (for example, yellow) into position, and the carriage again moves forward to a location under the print head. Then, the card, which has been printed with the first and second dyes, is printed with the third dye to produce the full-colored image. Of course, it is not necessary that the surface of the card be printed with three primary dye colors. Rather, the card can be printed with a single color such as black if monochrome imaging is desired.

After the image has been printed completely on one surface of the card, the carriage transports the card to a card-flipping station, where the card is flipped over so that the reverse, unprinted side of the card faces upwardly in the carriage. Then, the carriage holding the inverted card moves rearward and transports the card to the print-starting position. The same or different indicia that was printed on the first surface of the card can be printed now on the second surface of the card per the above-described printing process. In the present invention, an improved card-flipping station is provided.

The card-flipping device of the present invention is shown and generally indicated at 4 in FIG. 1. The card-flipping device 4 comprises a U-shaped card-carrier unit generally indicated at 6 that includes an upper wall portion 8 and extending sidewall portions 10, and 12, and a pair of opposing card flip guides 14 and 16 adapted for receiving the card 18. The card-carrier unit 6 can be a single unitary piece, or can comprise two pieces 8*a* and 8*b* that are secured together by bolts or other suitable fastening means as shown in FIG. 1. The outer flip guide 14 and the inner flip guide 16 are rotatable as described in further detail below. The card-carrier unit 6 is slidably attached to a vertical guide rail 20 and coupled to a drive motor 21 (FIG. 3) that powers the unit upwardly and downwardly along the guide rail 20. More particularly, the card carrier unit 6 is powered vertically along a rack of teeth 23 by a spur gear 25 (FIG. 5A).

The card-flipping device 4 further includes a side frame 22 that is perpendicular to a base frame 24. The side frame 22 and base frame 24 of the card-flipping device 4 are mounted to the housing 26 of the printer. The side frame 22 supports the vertical guide rail 20 and actuator assembly 28 as described in further detail below. The base frame 24 is an integral unit having four side wall segments 30, 32, 34 and 36 that define an open central area 38 adapted for receiving the card-carrier unit 6. As shown in FIG. 1, the side wall segment 30 of the base frame 24 contains a notched portion 40 adapted for receiving a bearing 44 that supports an outer shaft 42. The opposing end of the shaft 42 is connected to the outer flip guide 14. An adjustable friction means 45 is attached to the shaft 42 to dampen oscillation after flipping of the card 18 has occurred.

Figure 2:
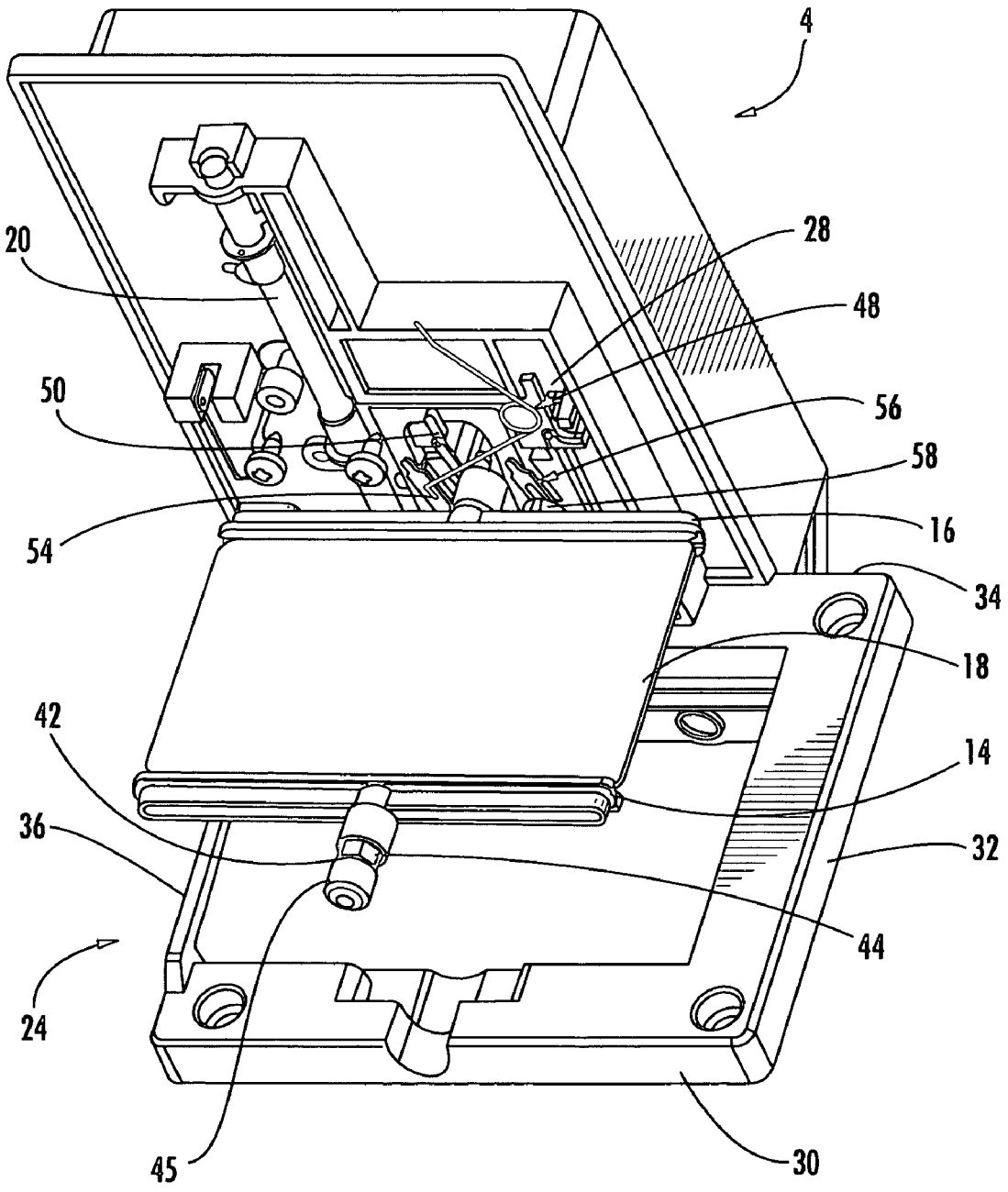
FIG. 2 is a cut-away isometric view of the device shown in FIG. 1 with the U-shaped frame of the card-carrier unit removed.
Figure 3:
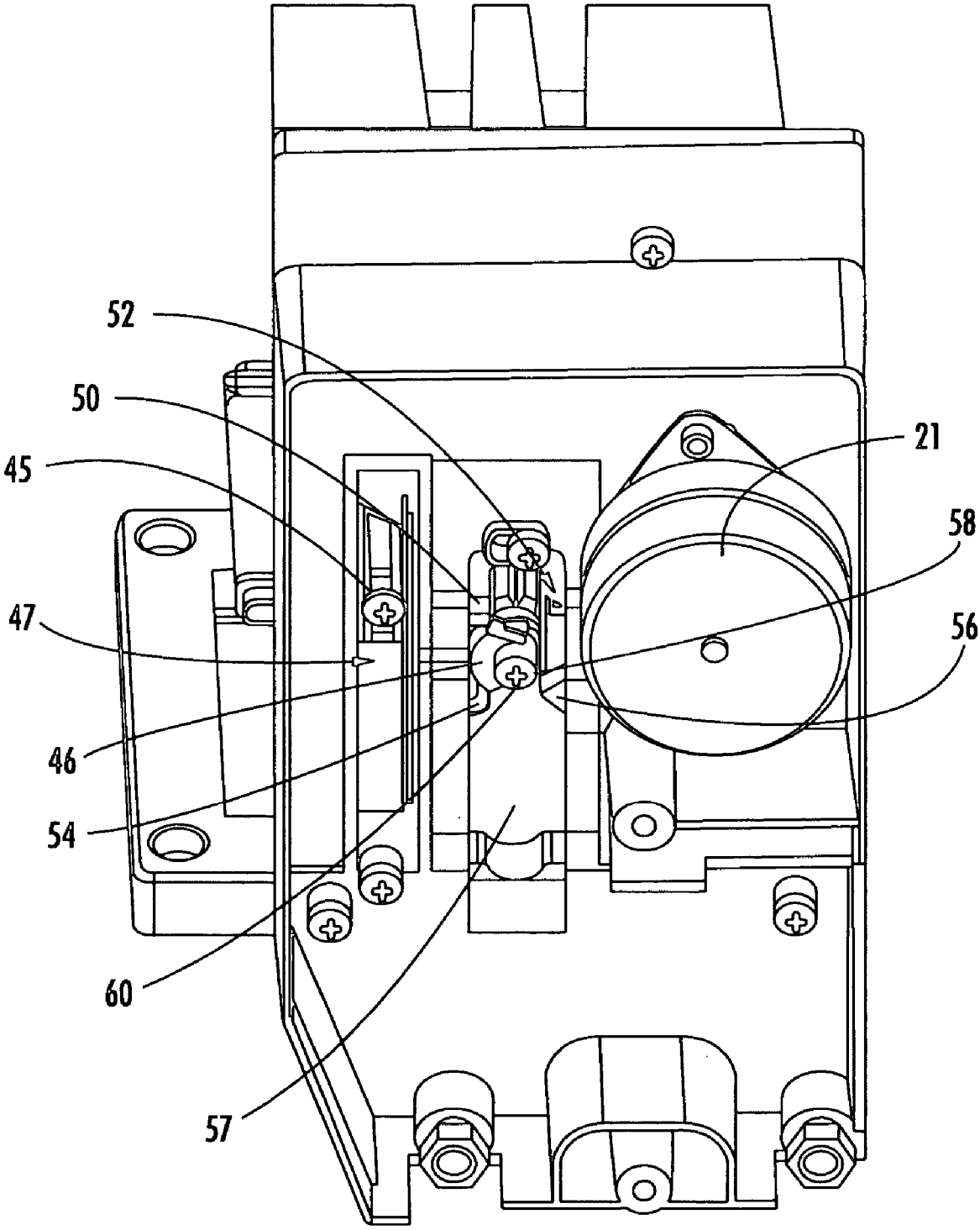
FIG. 3 is an isometric view of the rear of the device in FIG. 2 showing the actuator assembly.

As illustrated in FIGS. 2 and 3, the card-flipping device 4 further includes an actuator assembly generally indicated at 28. The actuator assembly 28 comprises a rotatable cam arm 46, spring means 48, a pair of sliding flip stop members 50 and 52, and a pair of flip stop actuator levers 54 and 56.

The rotatable cam arm 46 is connected to the inner flip guide 16 and supported by a bearing 58 which is fastened by a suitable screw 60. The cam arm 46 is slidably mounted within a vertical cam arm channel 57 and is raised and lowered with the card-carrier unit 6. At a pre-determined point during upward travel, a force is exerted on the cam 46 by the flip stop 50 that causes the cam 46 and card flip guides 14 and 16 to rotate. The present invention employs a non-motorized means for rotating the flip guides 14 and 16 and flipping the card 18 over as described in further detail below. The sliding flip stop members 50 and 52 are connected to the actuator levers 54 and 56 so that a force exerted on the levers 54 and 56 causes the flip stop to slide from a first position to a second position as described in further detail below.

In addition, the card-flipping device 4 includes an azimuth adjuster 45 that is attached to the card-carrier unit 6. The azimuth adjuster 45 engages the side frame 22 of the card-carrier unit 6 and slides upwardly and downwardly on a vertical guide rib 47. The azimuth adjuster serves to align the flip guides with the card carriage. Also, the drive motor 21 is shown in FIG. 3, and this motor 21 powers the card-carrier unit 6 vertically along the guide rail 20 via a rack 23 and spur gear 25.

The card-flipping device 4 of the present invention can be used in a printing apparatus to turn a card 18 over so that both sides of the card can be printed and laminated thereon as desired. The card-flipping device 4 is particularly suitable for thermal printers having a linear transport system as described in the foregoing Nardone patents. This transport system comprises: (i) a carriage for transporting the card, (ii) a linear guide means for guiding the carriage to the thermal print station and other stations in the printer; and (iii) a reversible drive means for driving the carriage in forward and reverse directions along the linear guide means. The card-flipping device 4 of the present invention can be installed so that it is located downstream of the thermal printing station.

In general, the carriage conveys the card 18 to the card-flipping device 4, where the card 18 is guided from the carriage to the card-retaining flip guides 14 and 16 of the card-carrier unit 6. The card 18 is transported vertically along the vertical guide rail 20 to a position, where the flip guides 14 and 16 can rotate and flip the card 18 over. Then, the card-carrier unit 6 is lowered, and the inverted card 18A is returned to the carriage.

More particularly, the raising and lowering of the card-unit carrier 6 and the card-flipping sequence are illustrated in FIGS. 4 to 11A.

Figure 4:
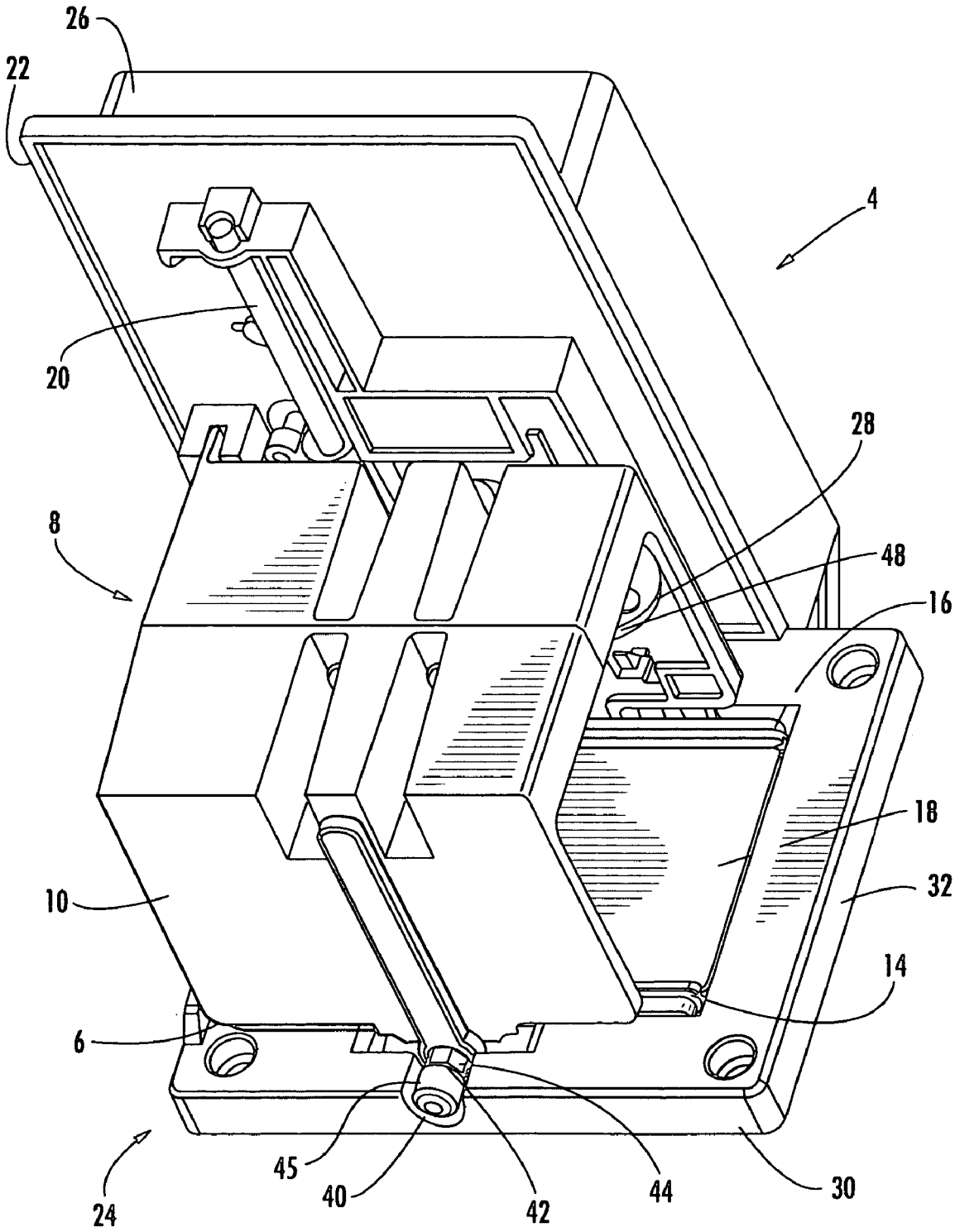
FIG. 4 is an isometric view of the card-flipping device showing the card-carrier unit at a starting/ending position of the card-flipping sequence.
Figure 4A:
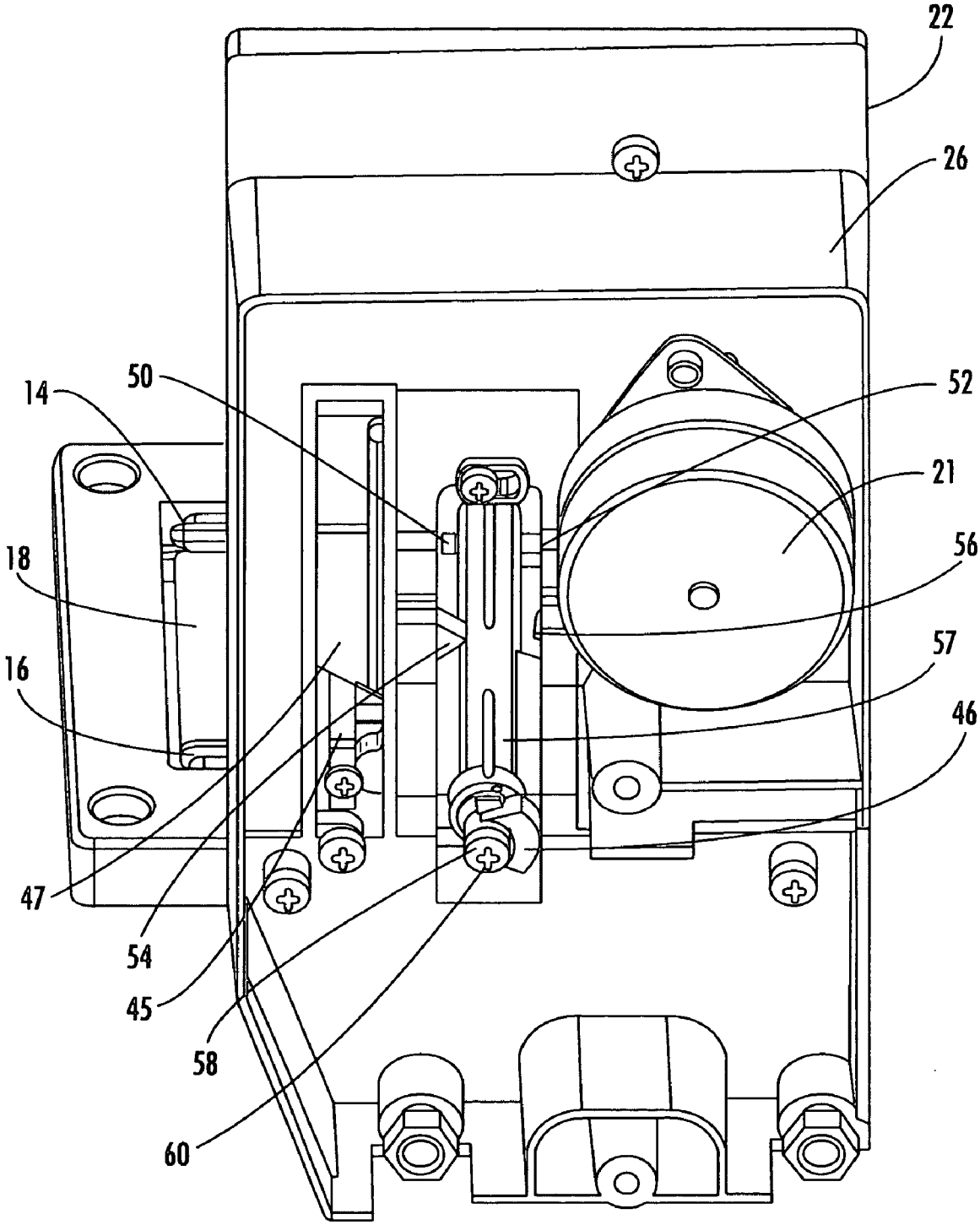
FIG. 4A is a rear view of the device in FIG. 4 showing the actuator assembly at a starting/ending position of the card-flipping sequence.

Referring first to FIGS. 4 and 4A, the card-carrier unit 6 is shown in a non-elevated, starting position. As a carriage or other transporting device (not shown) moves the card 18 to the stationary card-carrier unit 6, the side edges of the card 18 are guided into the flip guides 14 and 16 which contain channels adapted for receiving and retaining the card. The gripping of the card by the flip guides 14 and 16 is described in further detail below. Then, the card-carrier unit 6 begins ascending along the vertical guide rail 20.

Figure 5:
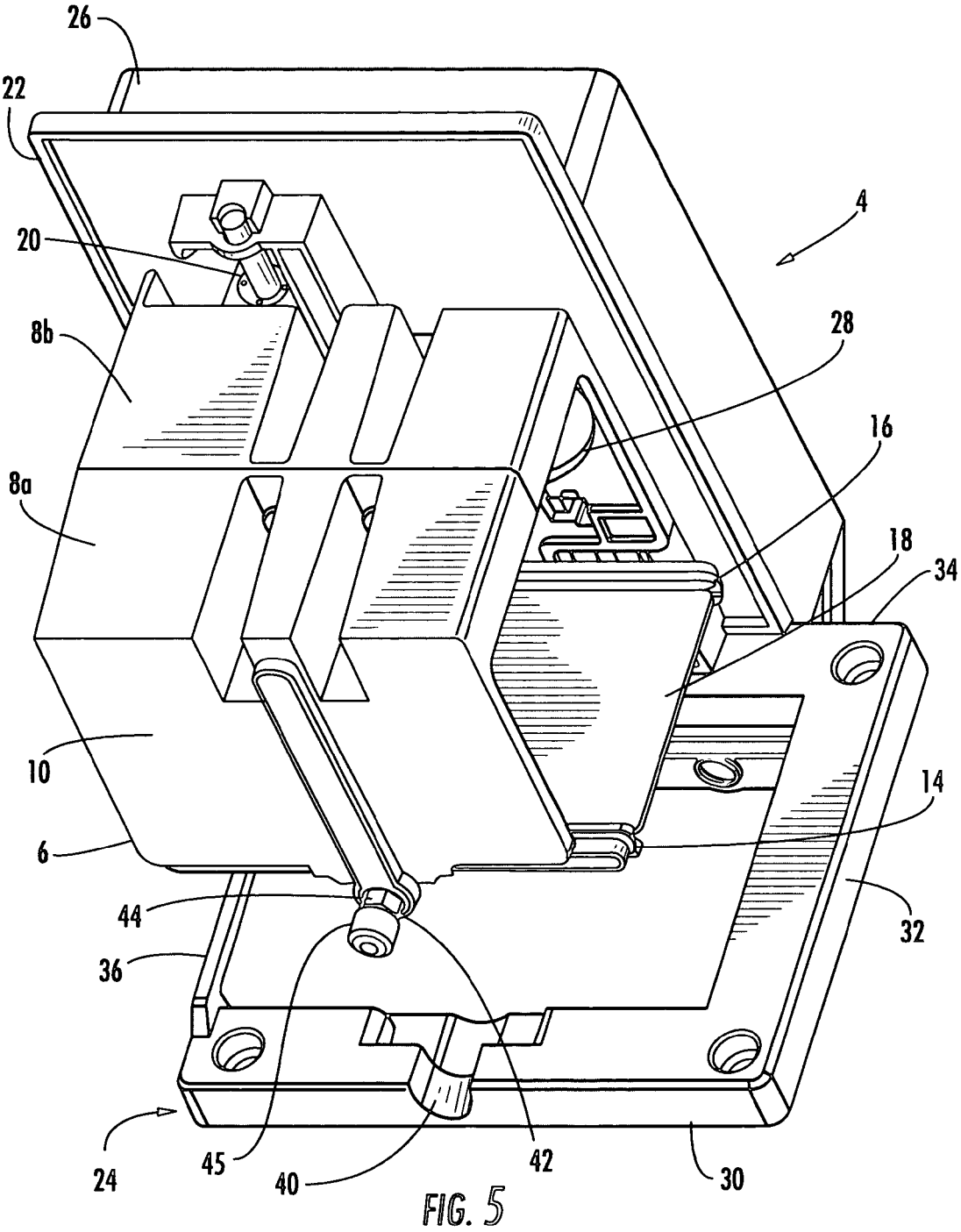
FIG. 5 is an isometric view of the card-flipping device showing the card-carrier unit at a flip-starting position.
Figure 5A:
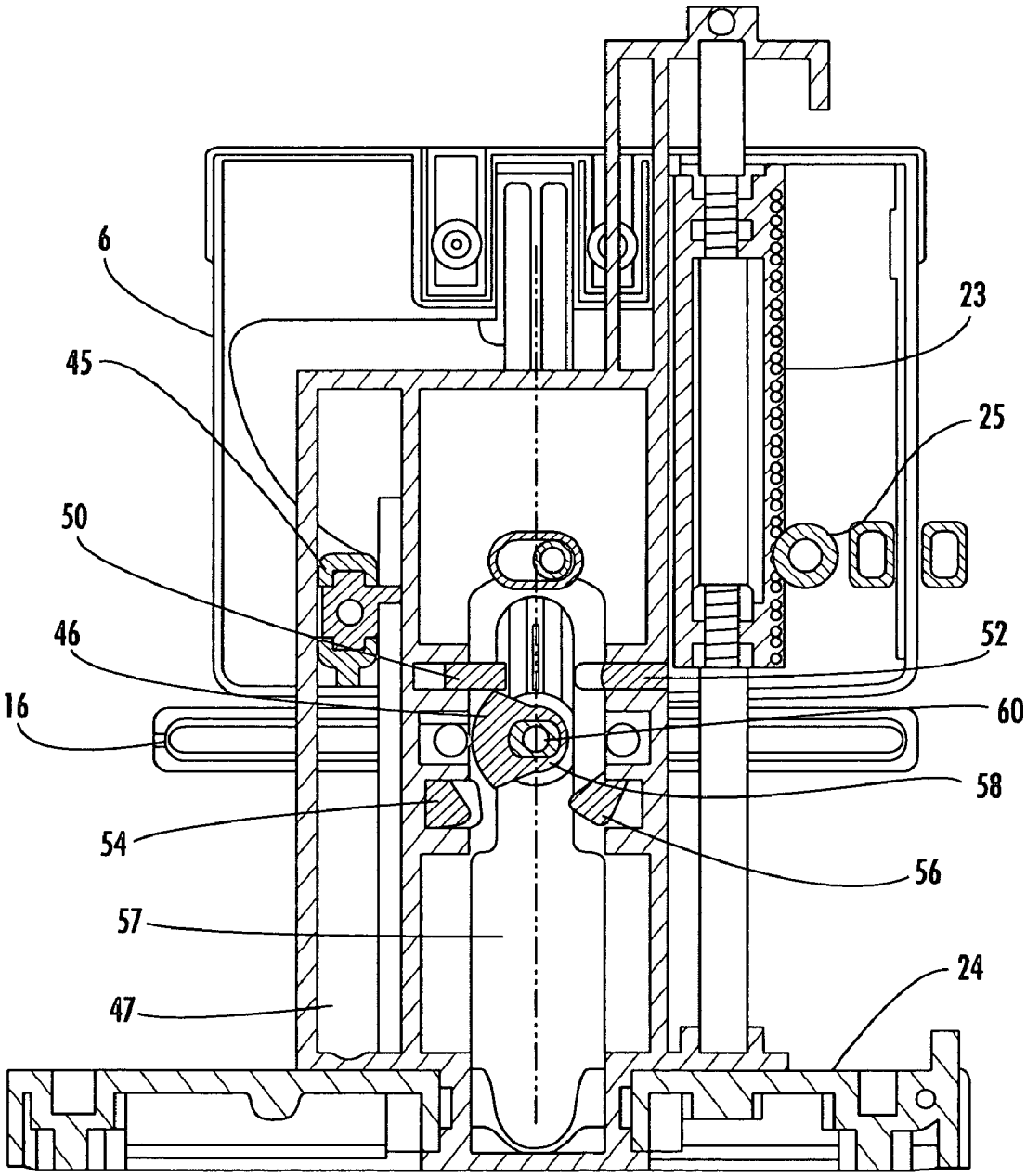
FIG. 5A is a cut-away orthogonal view of the device in FIG. 5 showing the actuator assembly at a flip-starting position.

Turning next to FIGS. 5 and 5A, the card-carrier unit 6 is shown as having ascended to a point, where the cam arm 46 engages the flip stop member 50. The card 18 is considered now in a "flip-starting" position. The sliding flip stop members 50 and 52 are shown in a stationary first position. A reaction force is exerted on the cam arm 46 by the flip stop 50 so that the arm 46 begins to rotate about its axis, thereby causing the flip guide channels 14 and 16 to rotate.

More particularly, the cam arm 46 is connected to the inner flip guide channel 16. A bearing 58, which is fastened by a screw 60, supports the cam arm 46. Rotation of the cam arm 46 positively drives rotation of the inner flip guide 16. Since the card 18 lies transversely between the card flip guides 14 and 16 and is tightly secured thereto, the flip guides act as one rotatable unit, and the outer flip guide channel 14 moves and rotates with the inner flip guide channel 16.

Figure 6:
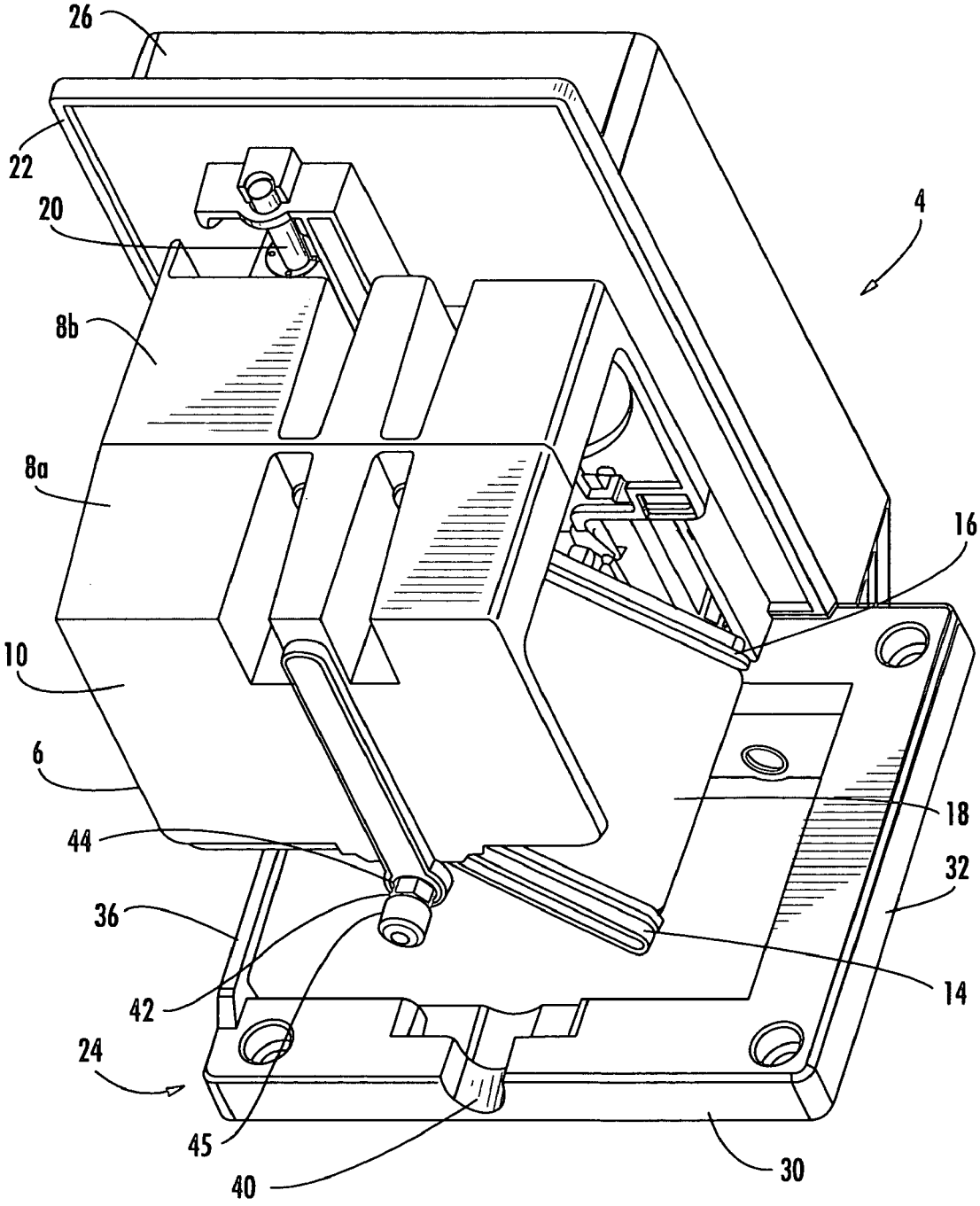
FIG. 6 is an isometric view of the card-flipping device showing the card-carrier unit at a flip position of 45 degrees.
Figure 6A:
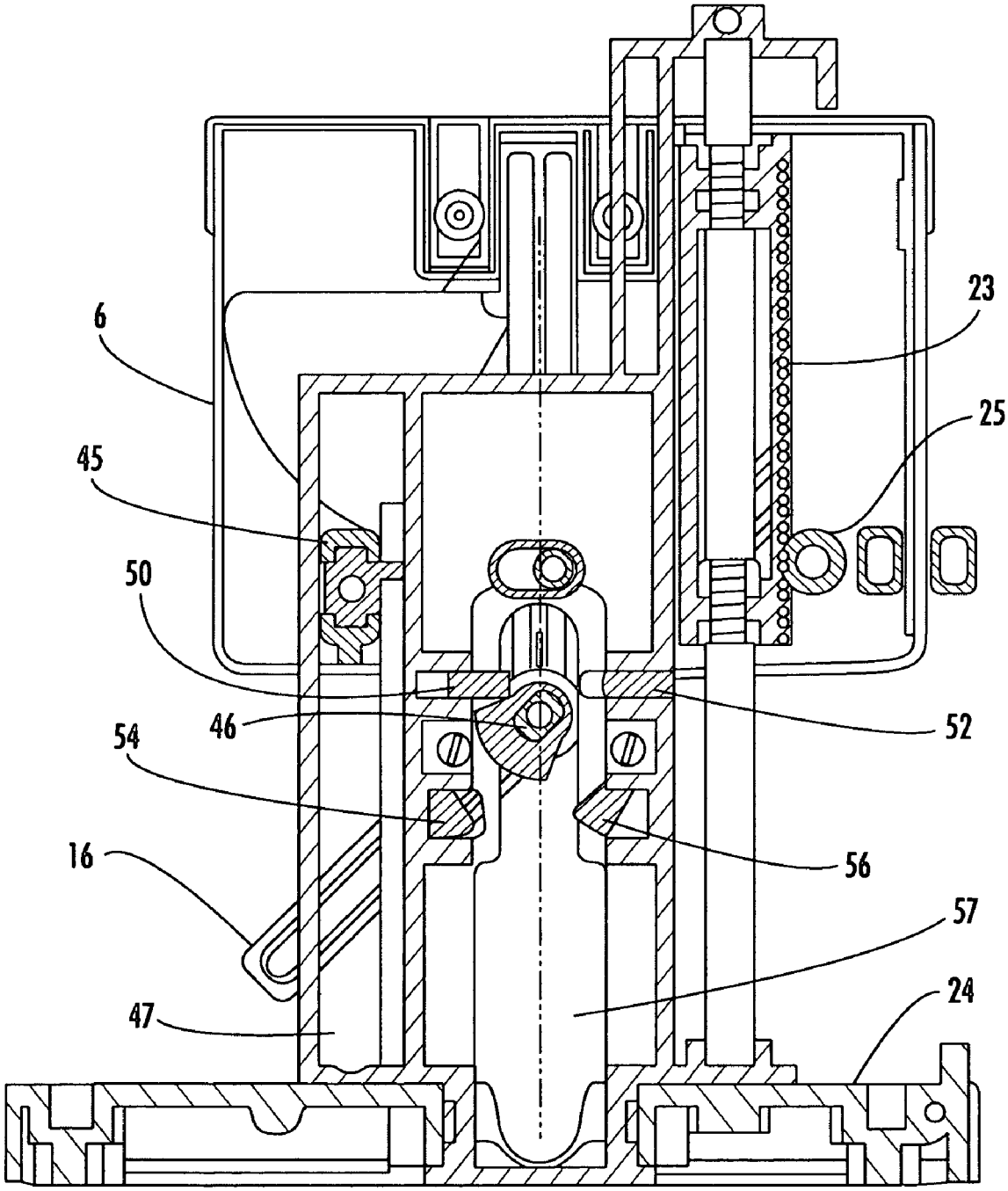
FIG. 6A is a cut-away orthogonal view of the device in FIG. 6 showing the actuator assembly at a flip position of 45 degrees.
Figure 7:
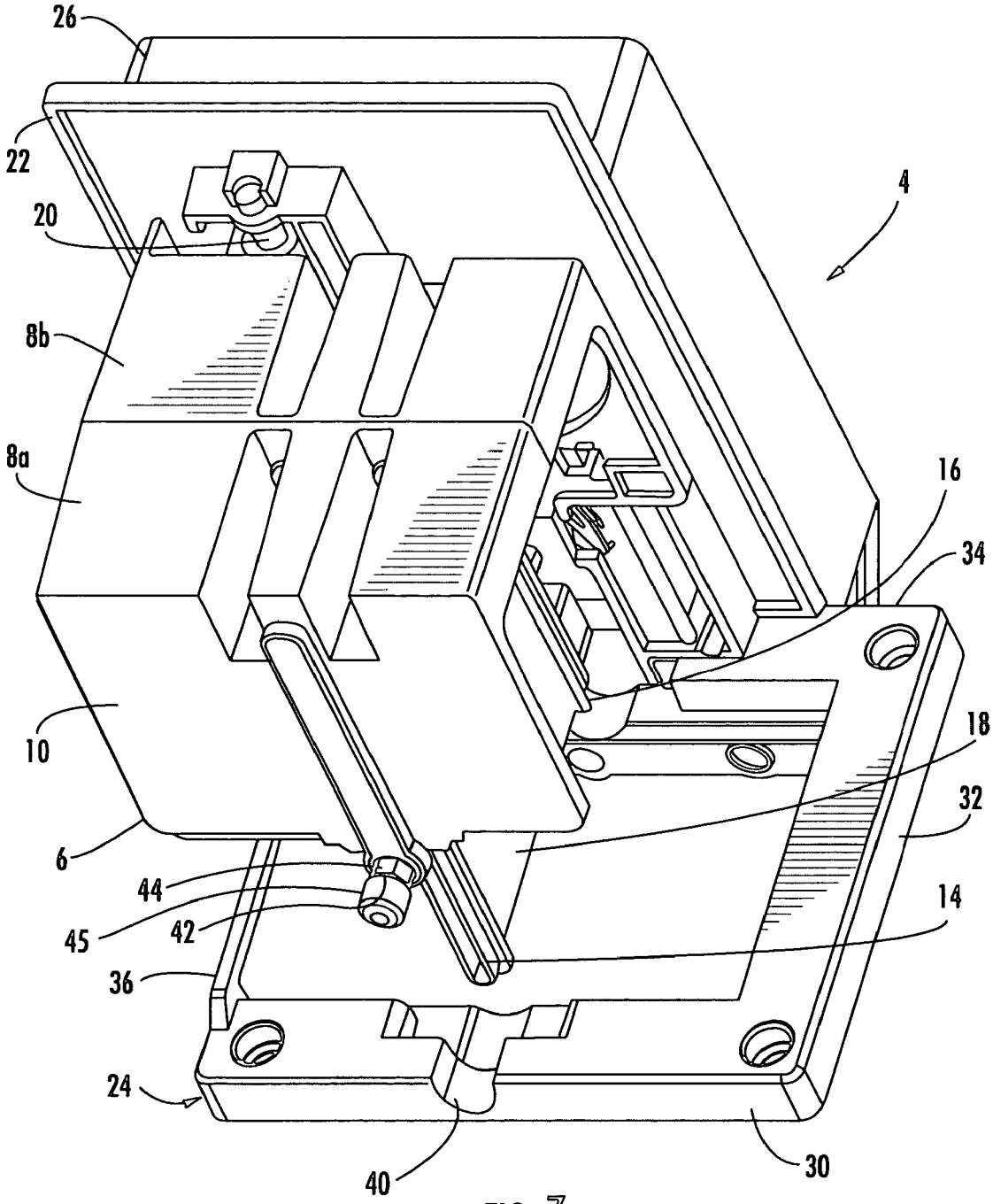
FIG. 7 is an isometric view of the card-flipping device showing the card-carrier unit at a flip position of 90 degrees.
Figure 7A:
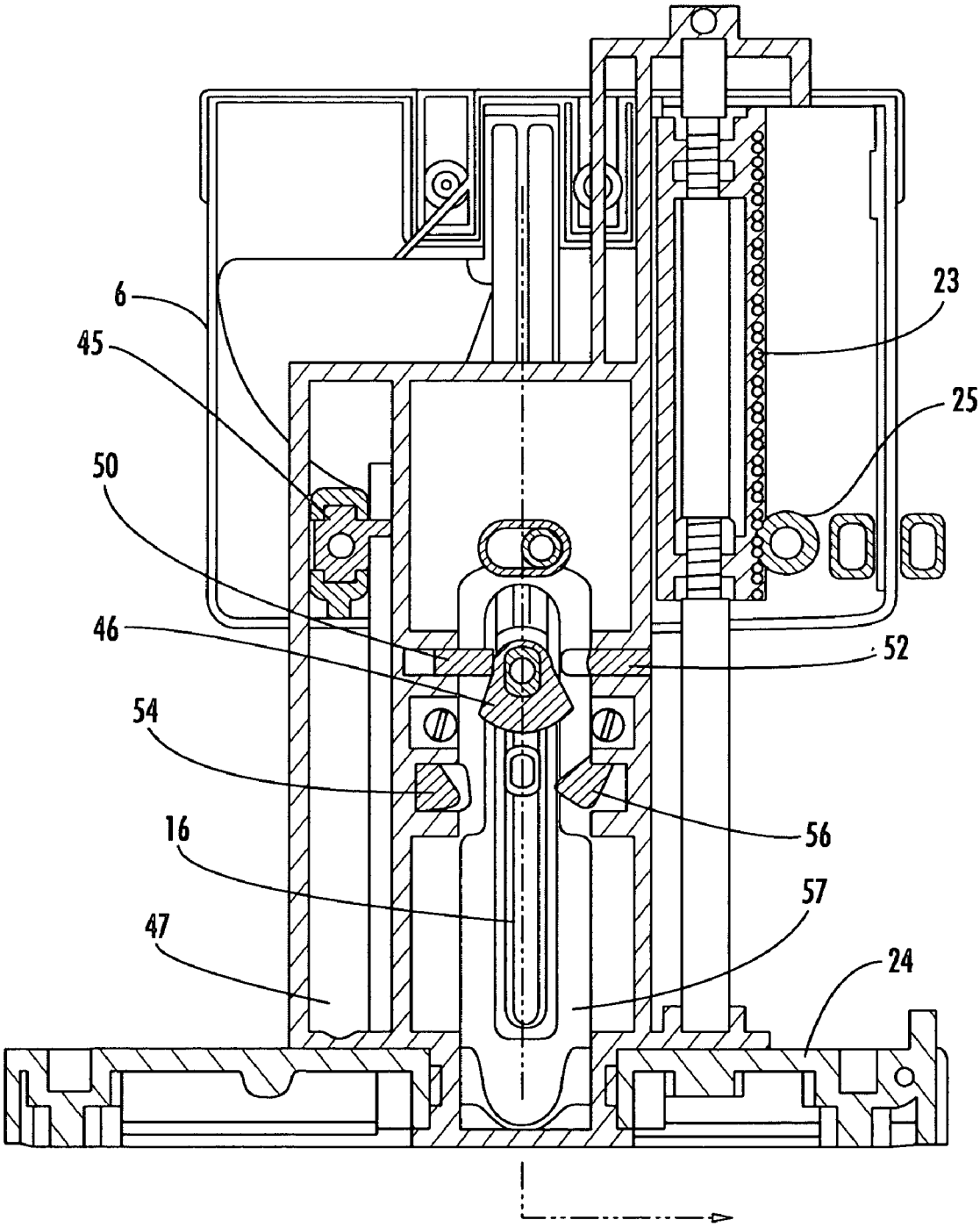
FIG. 7A is a cut-away orthogonal view of the device in FIG. 7 showing the actuator assembly at a flip position of 90 degrees.

In FIGS. 6 and 6A, the card-retaining flip guides 14 and 16 are shown in a rotating position. The card 18 is in the process of being inverted. Particularly, the rotating flip guides 14 and 16 are shown at an angle of 45 degrees relative to the base frame 24. In FIGS. 7 and 7A, the flipping of the card 18 continues, and the flip guides 14 and 16 are shown at an angle of 90 degrees relative to the base frame 24.

Figure 8:
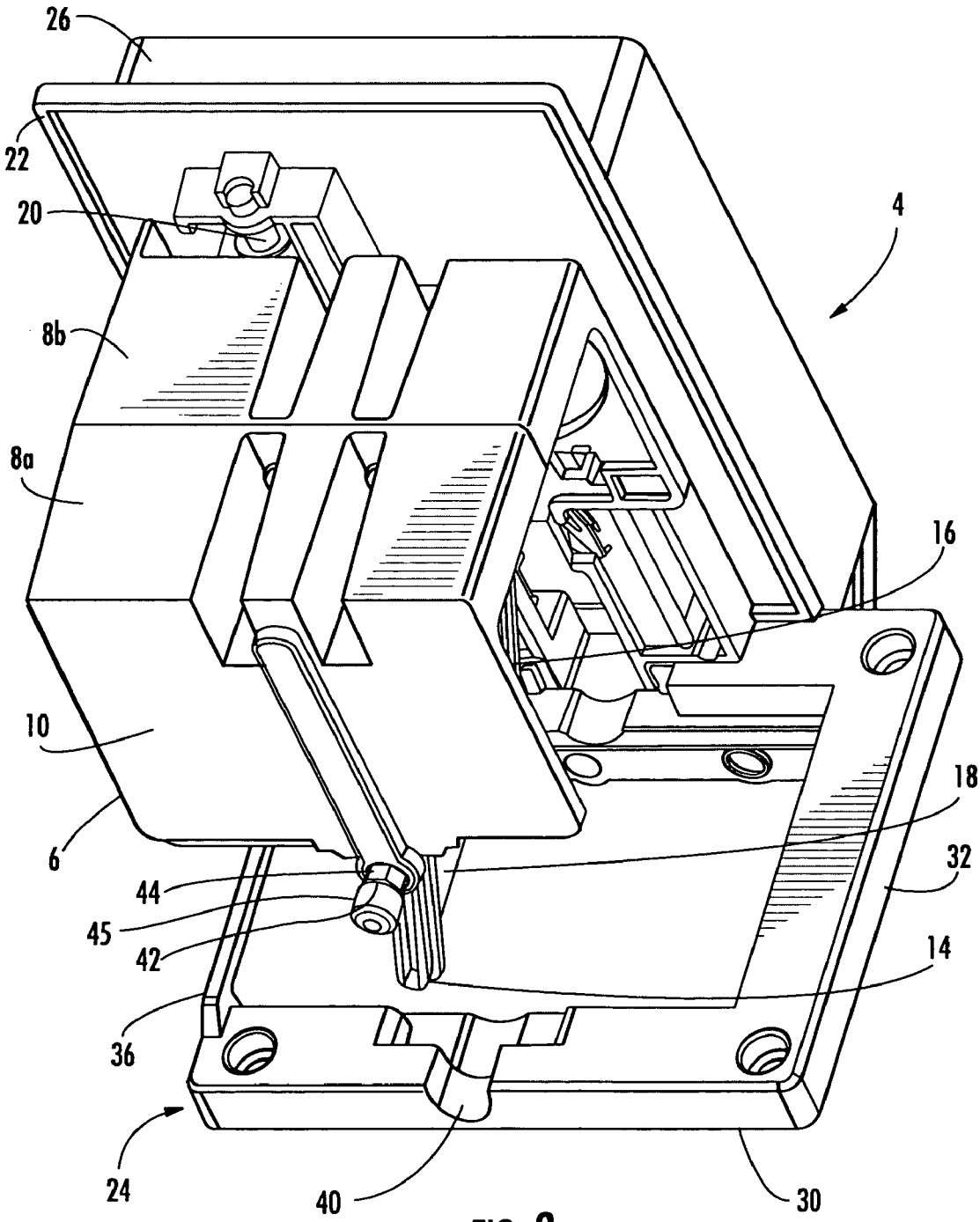
FIG. 8 is an isometric view of the card-flipping device showing the card-carrier unit at a flip position of over-center.
Figure 8A:
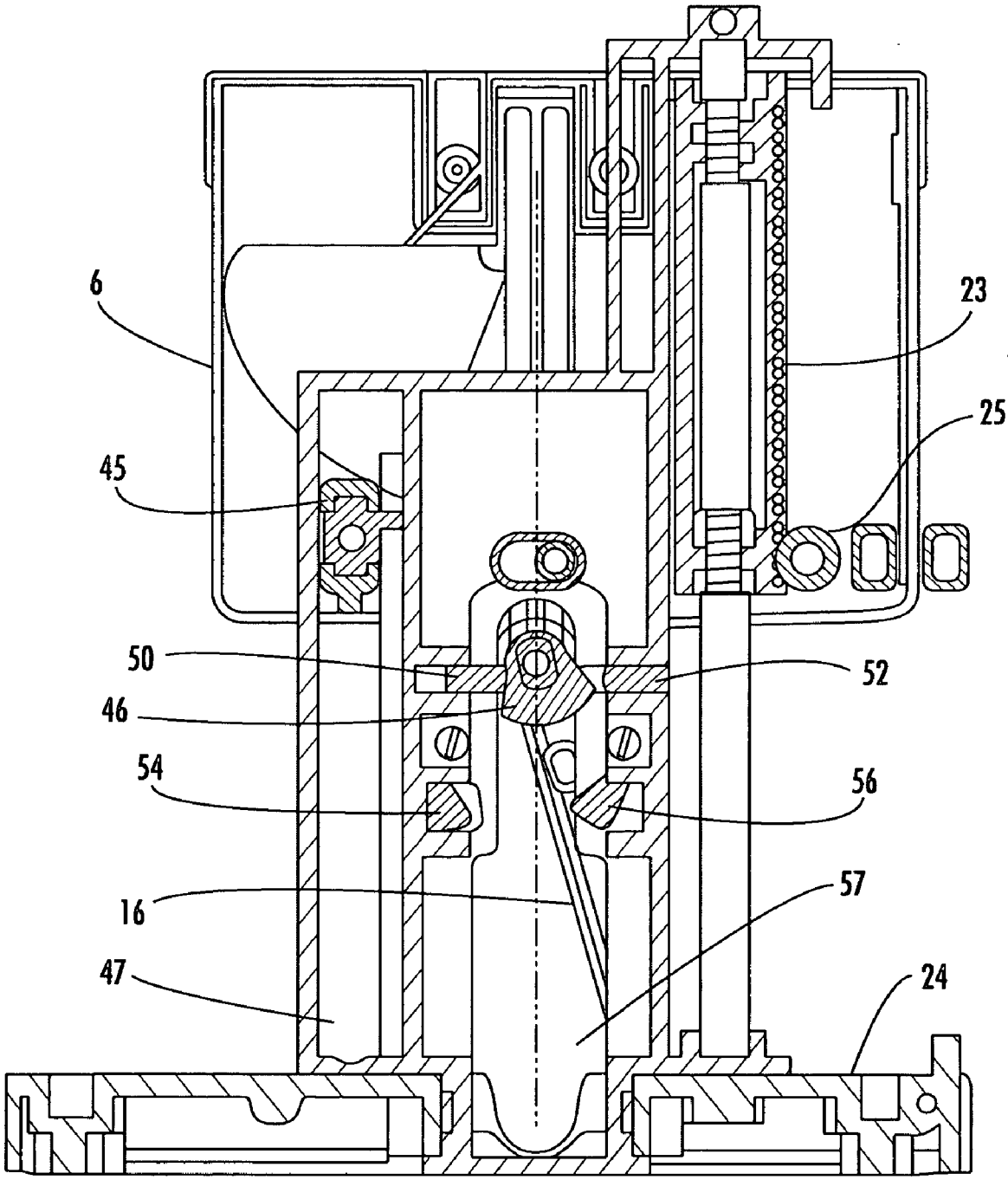
FIG. 8A is a cut-away orthogonal view of the device in FIG. 8 showing the actuator assembly at a flip position of over-center.
Figure 9:
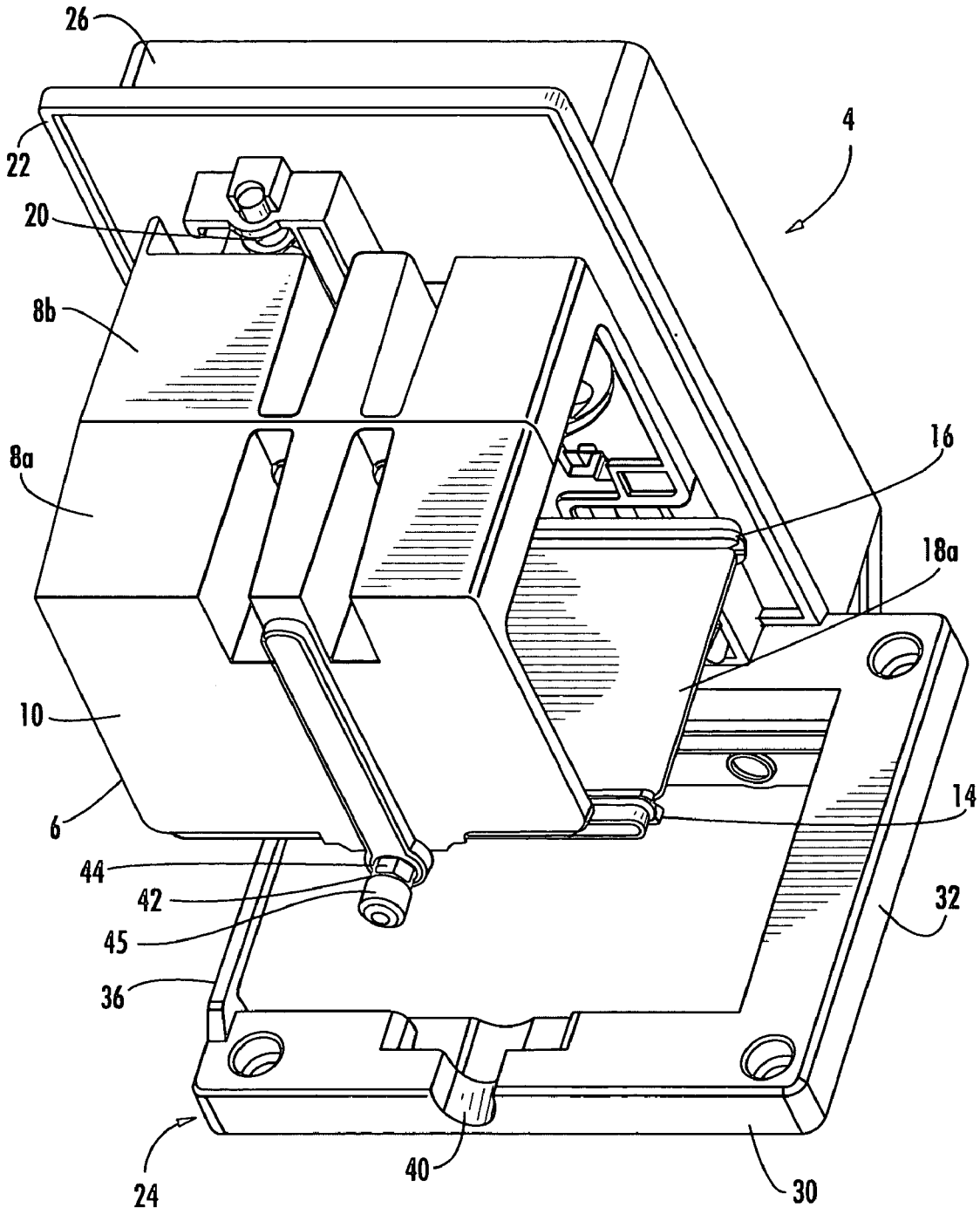
FIG. 9 is an isometric view of the card-flipping device showing the card-carrier unit at a flip completing position.
Figure 9A:
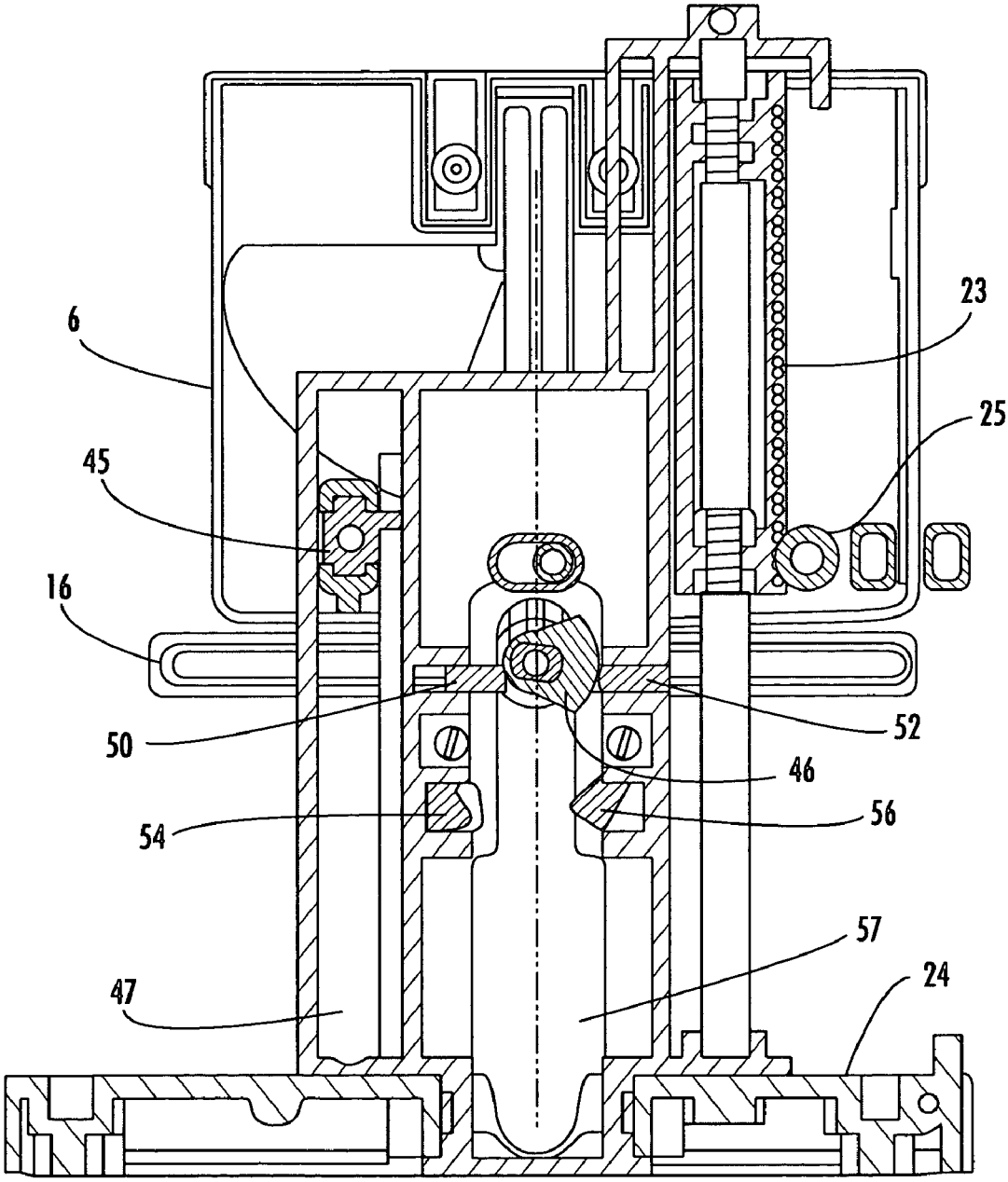
FIG. 9A is a cut-away orthogonal view of the device in FIG. 9 showing the actuator assembly at a flip completing position.

The flip guides 14 and 16 continue rotating the card 18 to a point "over-center' as illustrated in FIGS. 8 and 8A. At this over-center point, the force exerted by the spring 48 causes the flip guides 14 and 16 to complete their rotation. In FIGS. 9 and 9A, the flipping of the card 18 has been completed. The flip guides 14 and 16 have completed a 180 degree rotation and the card 18 has been flipped over. The inverted card in the flip guides 14 and 16 is indicated at 18*a*.

Figure 10:
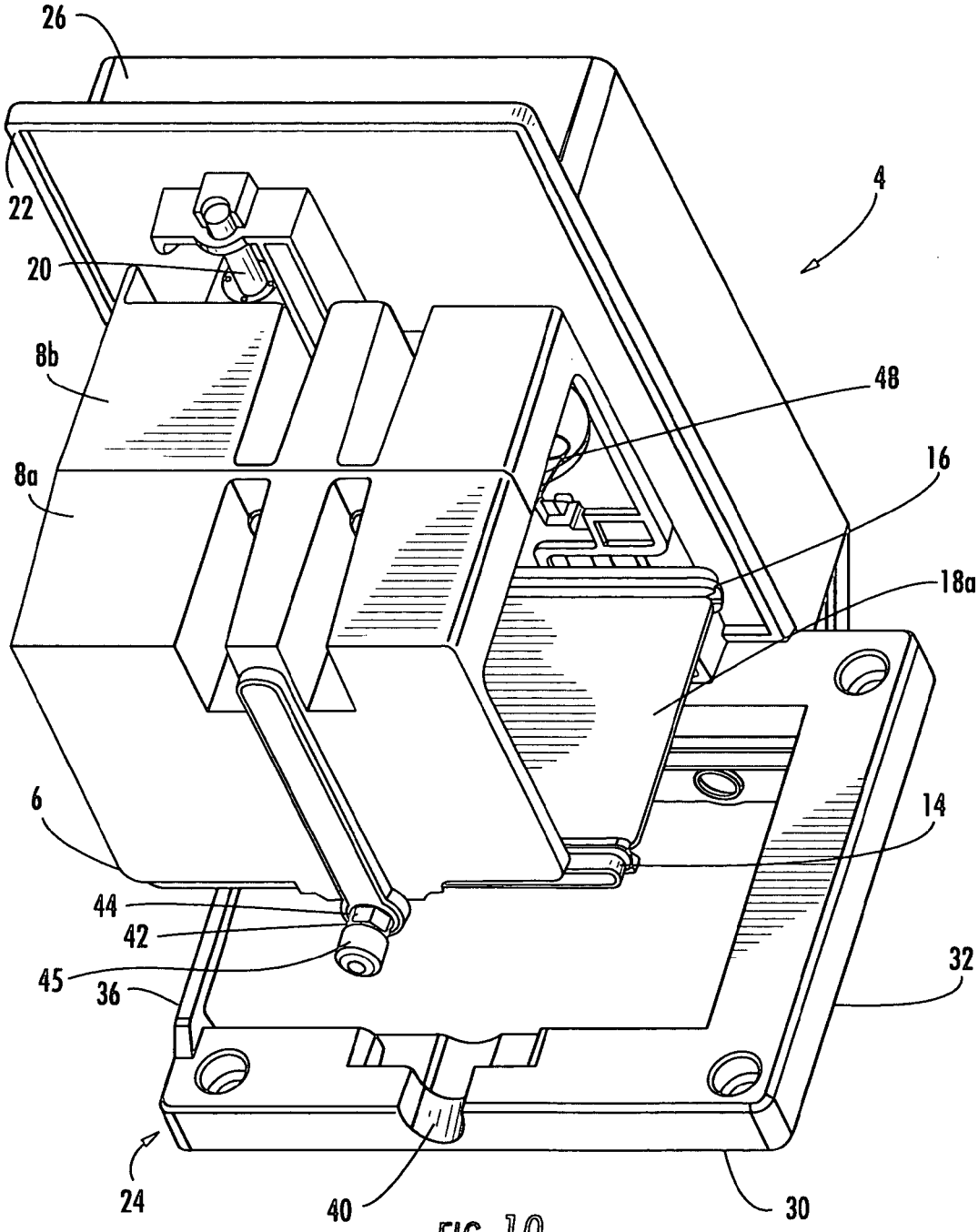
FIG. 10 is an isometric view of the card-flipping device showing the card-carrier unit at a first descending position.
Figure 10A:
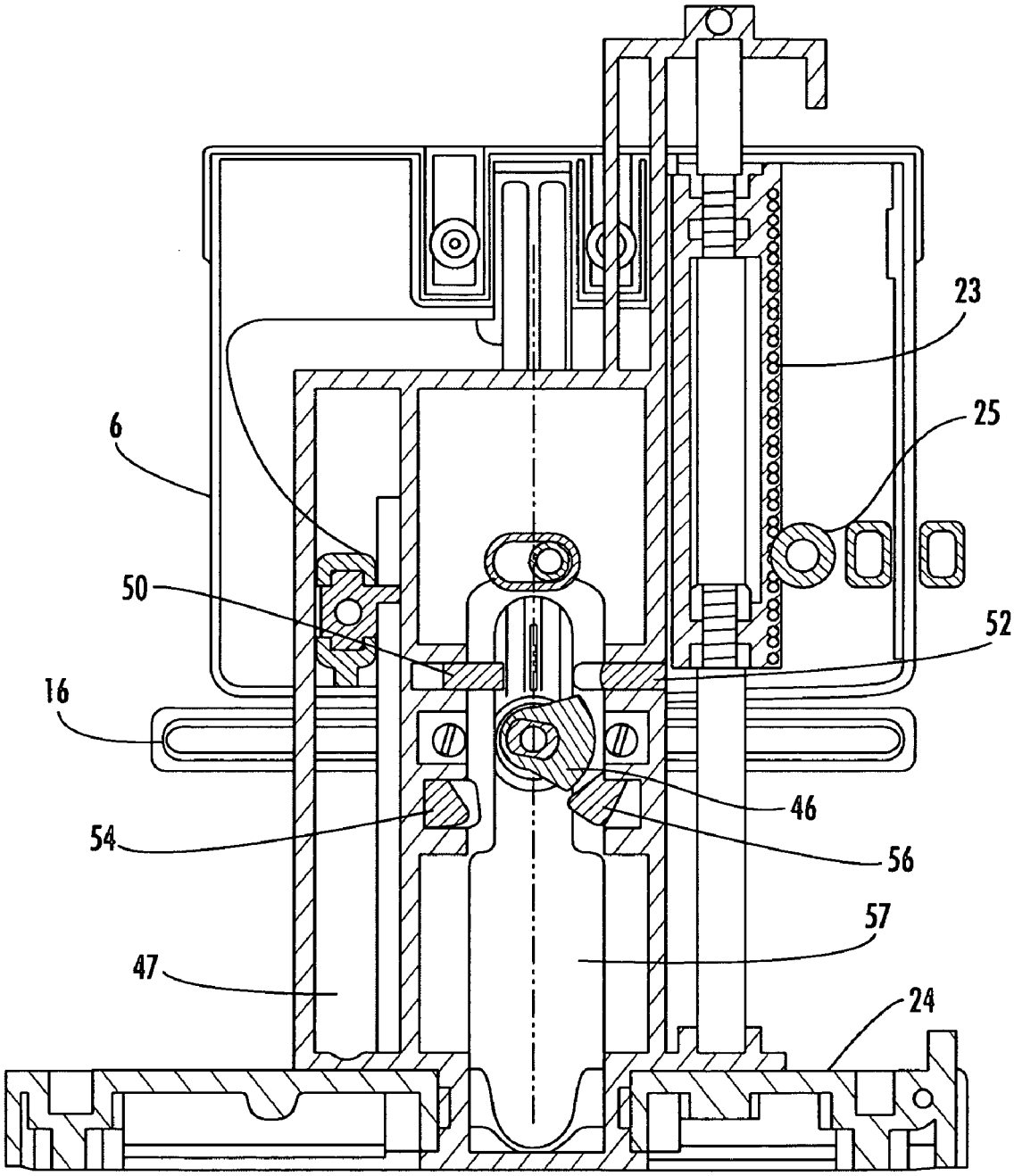
FIG. 10A is cut-away orthogonal view of the device in FIG. 10 showing the actuator assembly approaching the flip stop actuator levers.
Figure 11:
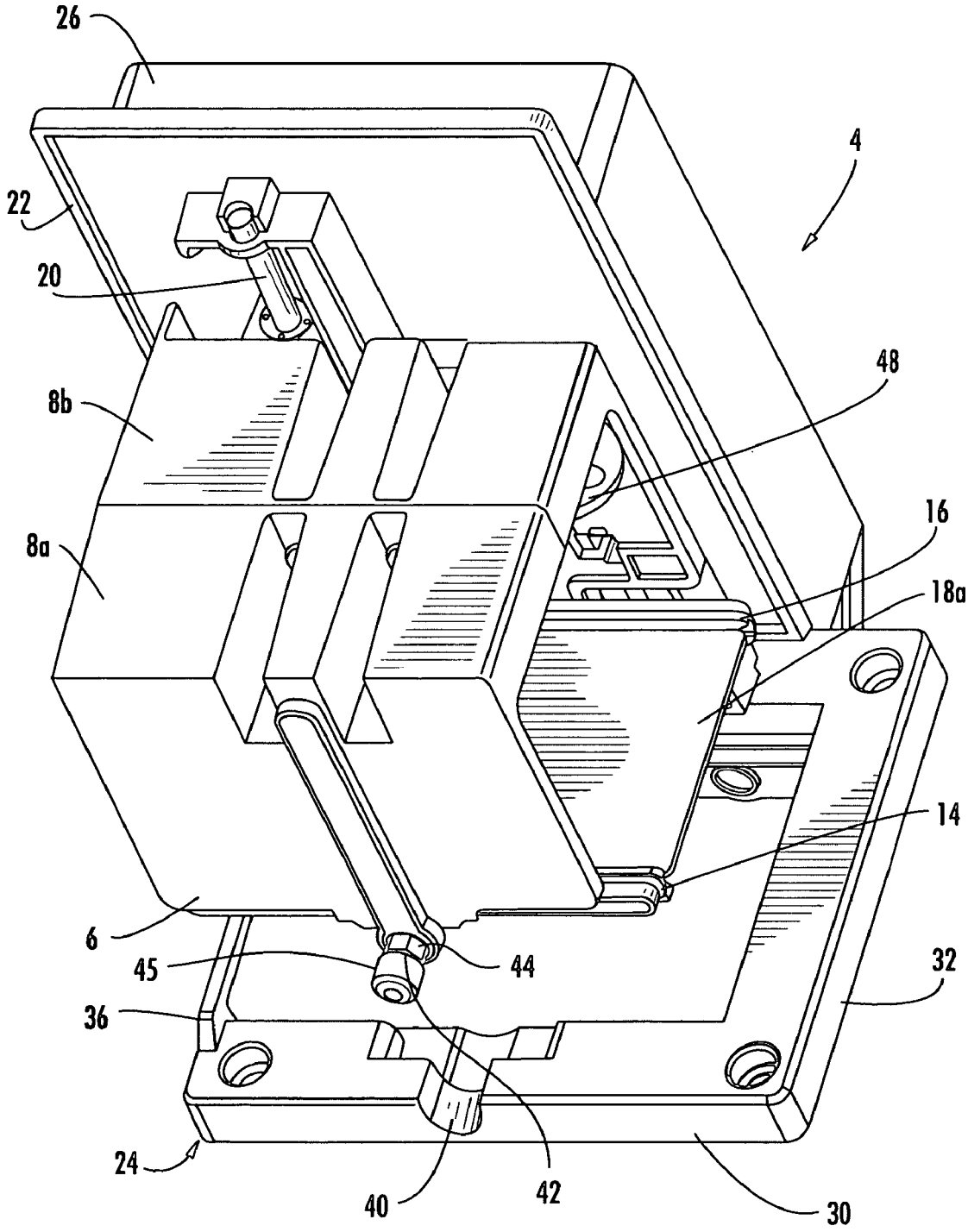
FIG. 11 is an isometric view of the card-flipping device showing the card-carrier unit at a second descending position, where the actuation of the actuator assembly has been completed.
Figure 11A:
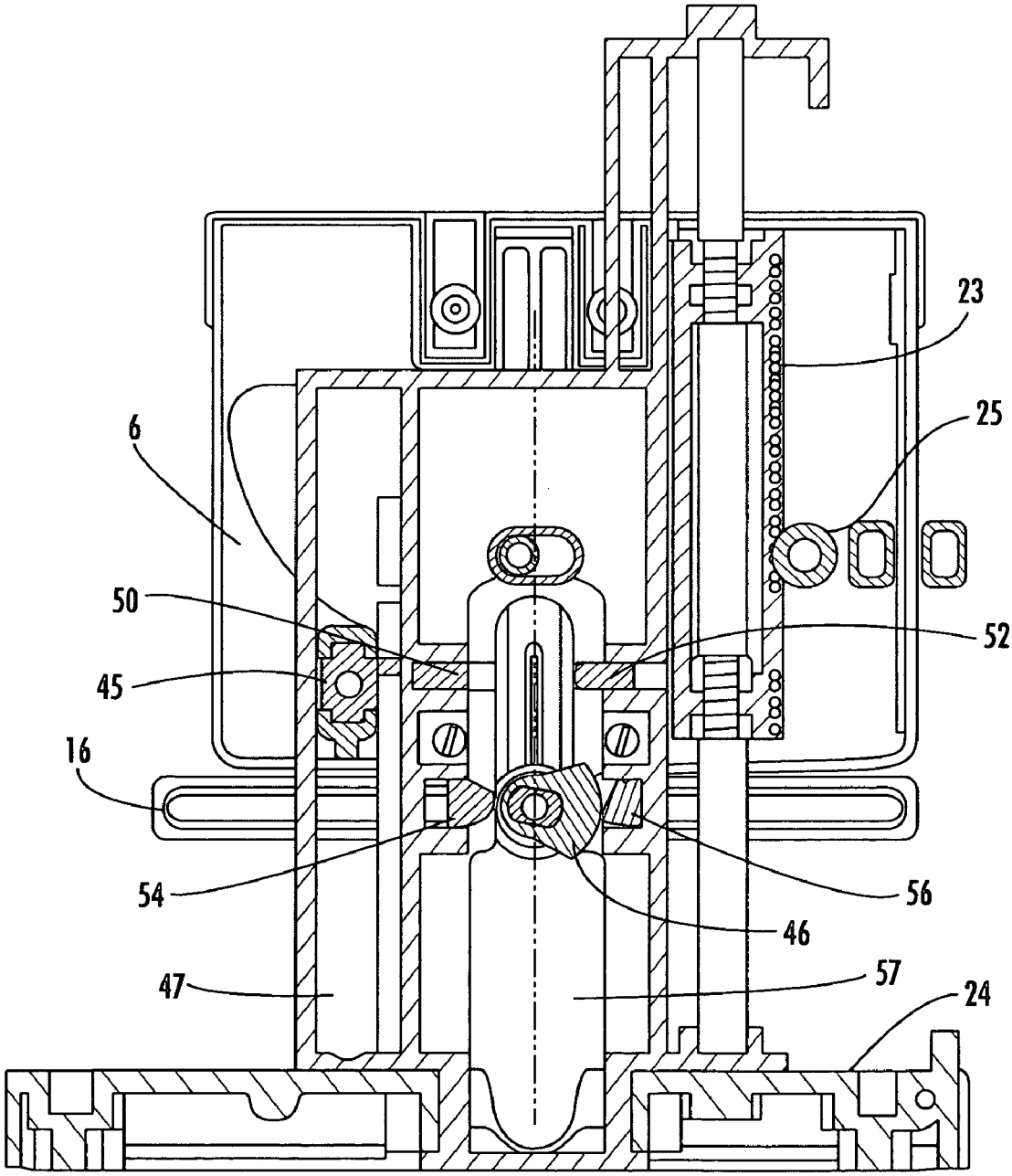
FIG. 11A is a cut-away orthogonal view of the device in FIG. 11 showing the actuator assembly at a position, where the actuation has been completed.

The card-carrier unit 6 supporting the inverted card 18*a* can now begin descending. The motor is reversed and the card-carrier unit 6 begins descending. In FIGS. 10 and 10A, the card-carrier unit 6 is shown descending along the vertical guide rail 20. The descending cam arm 46 is about to contact flip stop actuator lever 56. In FIGS. 11 and 11A, the card-carrier unit 6 is shown continuing its descent. In FIGS. 11 and 11A, the descending cam arm 46 has engaged the flip stop actuator lever 56, thereby causing the flip stop members 50 and 52 to slide from their first position to a new second position. Once the flip stop members 50 and 52 have shifted completely to their second position, the actuation of the actuator assembly 28 is considered complete. The card-carrier unit 6 continues descending and returns to its non-elevated, starting position as shown in FIGS. 4 and 4A.

Figure 12:
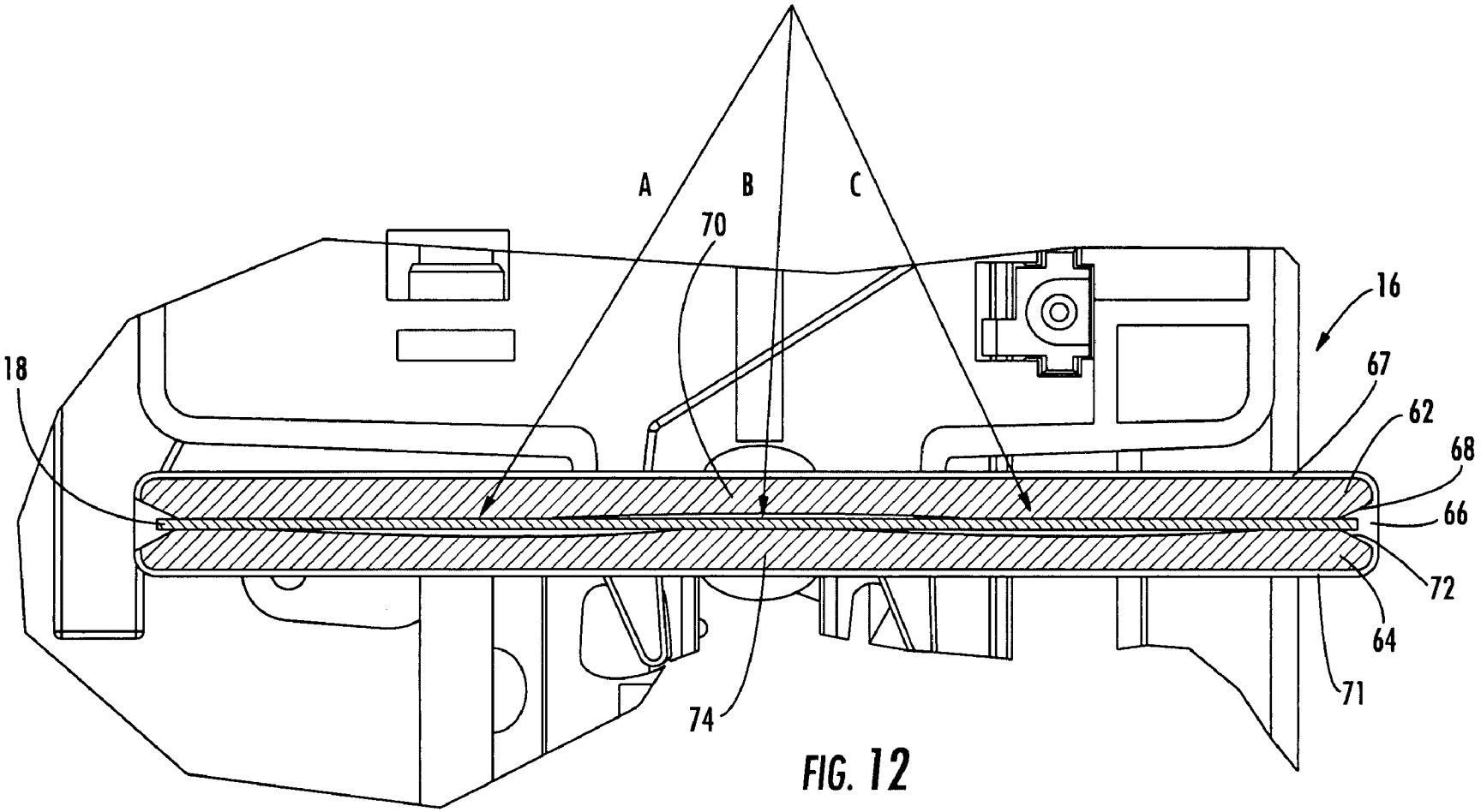
FIG. 12 is a cross-section view of the inner flip guide of the card-flipping device showing the gripping of a card by the flip guide.

Each of the card flip guides 14 and 16 is designed to grip the card 18 tightly. Referring to FIG. 12, one suitable structure for the flip guides 14 and 16 is shown. More particularly, a cross-sectional view of the inner flip guide 16 is shown in FIG. 12. In this embodiment, the outer flip guide 14, which is not shown in FIG. 12, would have a similar structure as flip guide 16. The flip guide 16 comprises a first elongated side frame member 62 and a second elongated side frame member 64 that are spaced apart to define a card-retaining channel 66 there between. The gap between the first side frame 62 and second side frame 64 can be any suitable dimension, and is typically about 0.040 inches. As shown in FIG. 12, the first side frame 62 has an outer edge 67 and inner edge 68, and the inner edge 68 has an undulating shape with two convex peaks (A and C) and a generally concave central portion 70. The second side frame 64 has an outer edge 71 and inner edge 72, and the inner edge 72 has an undulating shape with two convex peaks (A and C) and a generally convex central portion 74. Typically, the transverse distance between wave peak B and C is less than the smallest anticipated card thickness. This unique structure allows the side frames of each flip guide 14 and 16 to grip cards 18 of varying thickness with a three-point bending of the cards 18 within the card-retaining channel 66. The undulating structure of the side frame members allows the frames to grasp and hold the card 18 tightly. Typically, the cards 18 have a thickness in the range of about 0.028 to about 0.036 inches and are generally flexible.

The cards 18 are made from various materials. Examples of suitable card substrates include plain papers and films made from polyesters, vinyls (for example, polyvinyl chloride and polyvinyl acetate), polyamides, polyolefins (for example, polyethylene and polypropylene), polyacrylates, polyimides, polystyrenes, and the like. In many instances, a polyvinyl chloride plastic material is used to make the card. Also, the surfaces of the card are coated often with a polymeric thermal dye-receptive layer.

Figure 13:
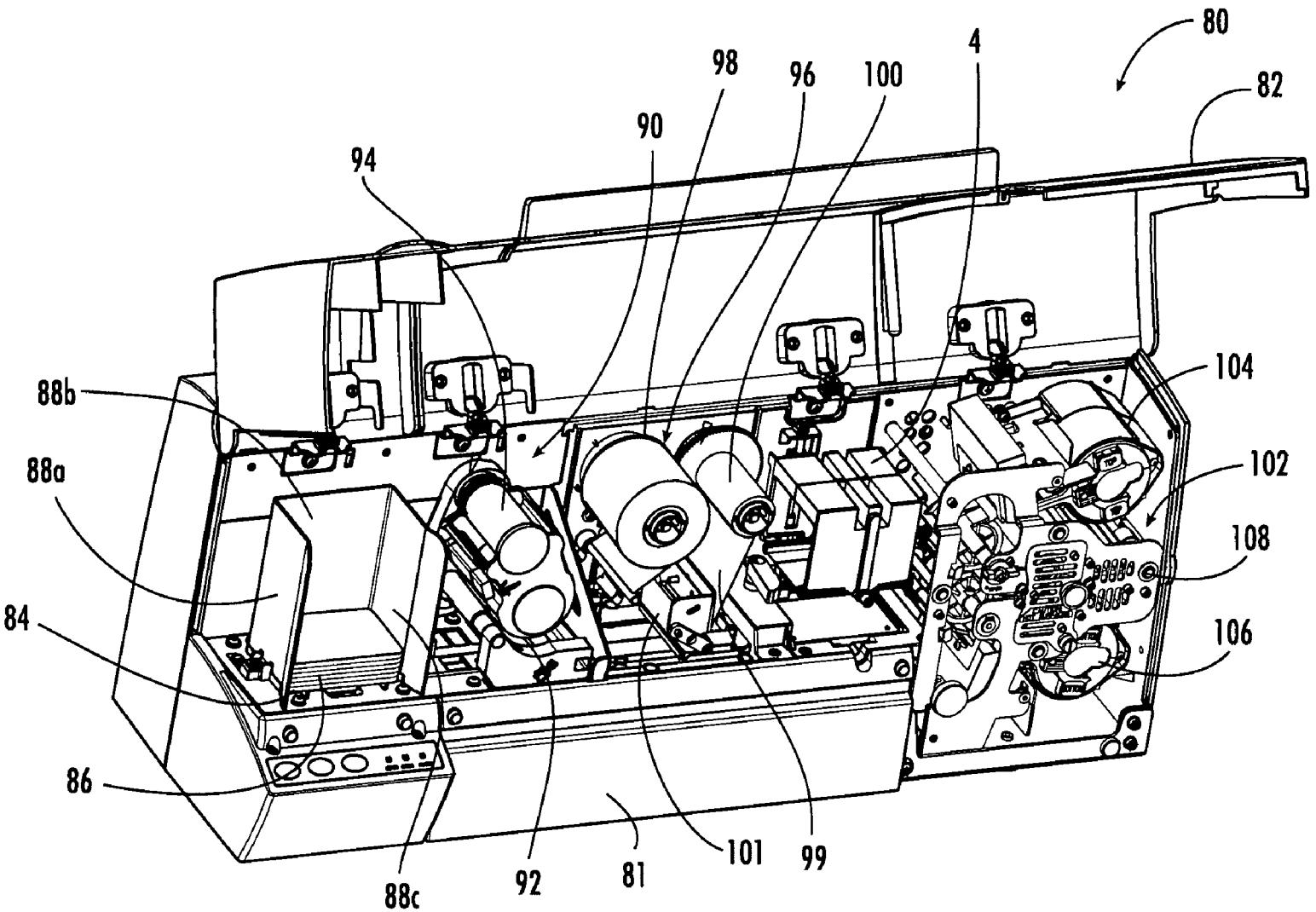
FIG. 13 is a perspective view of a thermal printer with its cover in an open position, the printer containing the card-flipping device of the present invention.

More specifically, the card-flipping device 4 of the present invention can be installed in a thermal card printer of the type which is generally indicated at 80 in FIG. 13. The card printer 80 includes a cover 82 which encloses the components of the printer. The cover 82 is shown in an open position in FIG. 13. The components of the printer 80 include a card hopper 84 for storing the cards 86 to be printed thereon. The card hopper 84 includes sidewall portions, 88*a*, 88*b*, and 88*c*, which define a rectangular chute for holding the cards 86. The bottom portion of the hopper 84 is open to allow a carriage (not shown) to move beneath the stack of cards 86 and pick-up a card for transporting through the various stations of the printer.

In operation, the carriage is positioned normally to the right of the card hopper 84. The carriage is driven rearward (to the left direction in FIG. 13) so that it passes beneath the card hopper 84. The card 86 located at the bottom of the stack is dropped into the carriage. Then, the carriage is driven forward (to the right direction in FIG. 13) and towards the card-flipping assembly 4 of this invention. The carriage is guided through the card-cleaning station and various other stations in the printer on a pair of parallel guide rails (not shown). The carriage is driven by a threaded rod (not shown) rotatably mounted in bearing assemblies located at each end of the printer frame. A reversible motor (not shown) can be used for rotating the threaded drive rod in forward and reverse directions so that the carriage moves in each direction. This card transport system is enclosed behind side panel 81 of the card printer 80.

The card 86 is transported to a card-cleaning assembly generally indicated at 90. The surfaces of the card 86 will collect dirt and dust particles, and other debris as the card passes through the various components and stations in the printer 80. The card-cleaning assembly 90 cleans this foreign matter from the surfaces of the card. The card-cleaning assembly 90 comprises a card-cleaning roller 92 and adhesive tape cartridge 94. The assembly 90 operates by bringing the cleaning roller 92 and card 86 into contact so that the roller 92 can remove debris from the surface of the card 86. Then, the adhesive tape 94 engages the cleaning roller 92 to removes the debris which has accumulated on the roller. In this manner, the surface of the card 86 is kept clean and high quality printed images can be produced on the surface of the card. This card-cleaning assembly is described in further detail in co-pending, co-assigned, U.S. patent application, "Card-Cleaning Assembly For Card Printing Devices", the disclosure of which is hereby incorporated by reference.

Subsequent to this cleaning step, the carriage is driven further to the right in FIG. 13 so that it passes beneath a thermal print assembly generally indicated at 96 which is used to print an image onto the surface of the card 86. The print assembly 96 includes a supply roll 98 and take-up roll 100 for feeding a thermal dye ribbon 99 between a thermal print head 101 and surface of the card 86. The print head moves between a first printing position and a second non-printing position. In the first position, the print head engages the card 86 and transfers thermal dye to the card. In the second position, the print head is in an idle position and disengaged from the card 86.

In a three-pass printing operation, the card 86 is passed under the print head in the order of three successive times to produce a full-colored image as discussed above. In the first printing pass, a first dye is thermally-transferred onto the card's surface. After this first printing step, the carriage holding the card 86 moves rearward and returns the card to a print-starting position. Then, the dye ribbon in the thermal print assembly 96 is advanced to place the second dye panel in proper position. The carriage again moves forward to a position under the print head so that the second dye can be transferred onto the card's surface. Subsequent to this second printing step, the card 86 is returned to the print-starting position. Finally, the dye transfer ribbon positions the third dye panel, and the carriage moves the card 86 forward to a location under the print head for printing with the third dye.

After this three-pass printing process, the carriage transports the card 86 to the card-flipping assembly 4 of this invention. The card-flipping assembly 4 flips the card 86 over in accordance with the flipping mechanism discussed above. Then, the carriage is driven again through the thermal print assembly 96 to produce a printed image on the back surface of the card 86. Both the front and rear surfaces of the card 86 are printed in this manner.

After these printing steps, the card is conveyed to a lamination station 102 for laminating the surfaces of the card 86 with a protective film. The laminating station 102 includes a top laminate film supply roll 104 and a bottom laminate film supply roll 106 which are driven independently by stepper motors. The laminate film is fed between the heated laminate assembly 102 and surface of the card 86. The laminating station 102 overlays the laminate film onto the surface of the card 86 to provide a protective, transparent covering. Finally, the printed and laminated card 86 is discharged from the printer 80 through an exit slot 108.

It is appreciated by those skilled in the art that various other changes and modifications can be made to the illustrated embodiments and description herein without departing from the spirit of the present invention. All such modifications and changes are intended to be covered by the appended claims.

What is claimed is:

1. A card-flipping device for turning a card over in a card printer, comprising:

a card-carrier unit for transporting the card in a vertical direction, the unit slidably attached to a vertical guide rail mounted to the frame of the printer, and the unit including at least one rotatable flip guide for holding the card;

a motor driven means coupled to the card-carrier unit for moving the unit in ascending and descending directions along the vertical guide rail; and an actuator assembly, comprising:

(i) a rotatable cam arm connected to said rotatable flip guide, the arm being capable of moving in ascending and descending directions with the card-carrier unit, (ii) a spring biasing means, (iii) a pair of sliding flip stop members, the members being in a first position, wherein the ascending cam arm engages a flip stop member and a force exerted by a spring means causes the cam arm to rotate 180 degrees, thereby turning the card over; and (iv) a pair of sliding flip stop actuator levers, wherein the descending cam arm of the card-carrier unit engages an actuator lever, thereby causing the flip stop members to slide from the first position to a second position.

2. The card-flipping device of claim 1, wherein the card-carrier unit has a U-shaped structure comprising an upper wall portion and two extending sidewall portions.

3. The card-flipping device of claim 1, wherein there are two rotatable flip guides including an inner flip guide and an outer flip guide, the inner flip guide being connected to the cam arm, and the outer flip being connected to a shaft.

4. The card-flipping device of claim 1, wherein the rotatable flip guide includes an azimuth adjuster that engages said rotatable flip guide and slides upwardly and downwardly within a vertical adjuster channel.

5. The card-flipping device of claim 1, wherein there are two rotatable flip guides, wherein each rotatable flip guide comprises a first elongated side frame member and a second elongated side frame member that are spaced apart to define a card-retaining channel there between, the first side frame member having an inner edge with a substantially concave central portion, and the second side frame member having an inner edge with a substantially convex central portion for gripping the card with the card-retaining channel.

6. The card-flipping device of claim 1, wherein the printer is a thermal card printer.

7. A thermal card printer apparatus, comprising:

a) a print station for thermally printing indicia on a surface of a card substrate;

b) a linear transport system for transporting the card beneath the print station, the linear transport system comprising:

(i) a carriage for receiving the card, wherein the surface of the card to be printed faces upwards in the carriage;

(ii) a linear guide means for guiding the carriage along the linear guide means; and (iii) a reversible drive means for driving the carriage along the linear guide means; and c) a card-flipping device for turning the card over, the card-flipping device comprising:

a card-carrier unit for transporting the card in a vertical direction, the unit slidably attached to a vertical guide rail mounted to the frame of the printer, and the unit including at least one rotatable flip guide for holding the card;

a motor drive means coupled to the card-carrier unit for moving the unit in ascending and descending directions along the vertical guide rail; and an actuator assembly, comprising:

(i) a rotatable cam arm connected to the card-carrier unit and said rotatable flip guide, the arm being capable of moving in ascending and descending directions with the card-carrier unit, (ii) spring biasing means, (iii) a pair of sliding flip stop members, the members being in a first position, wherein the ascending cam arm engages a flip stop member and a force exerted by a spring means causes the cam arm to rotate 180 degrees, thereby turning the card over; and (iv) a pair of sliding flip stop actuator levers, wherein the descending cam arm of the card-carrier unit engages an actuator lever, thereby causing the flip stop members to slide from the first position to a second position.

8. The thermal card printer apparatus of claim 7, further comprising a card-cleaning assembly for cleaning debris from a surface of the card.

9. The thermal card printer apparatus of claim 7, further comprising a laminating assembly for laminating a film to a surface of the card.

10. A device for use with a printer for reorienting media used by the printer, comprising:

a frame comprising at least one guide rail extending relative to a defined media path of a printer;

a carrier unit slidably coupled to said guide rail for transporting the media in a first direction and in an opposite direction along said guide rail;

at least one rotatable flip guide coupled to said carrier unit for holding the media; and at least one flip stop member adjacent said guide rail, wherein when said carrier unit slides along said guide rail, said flip stop member passively interacts with said rotatable flip guide causing said rotatable flip guide to rotate thereby reorienting the media located in said carrier unit, wherein said flip stop member is locatable in both an extended and a retracted position relative to said guide rail, wherein in the extended position said flip stop member interacts with said rotatable flip guide as said carrier unit slides along said guide rail to thereby reorient said rotatable flip guide.

11. A device according to claim 10, wherein said carrier unit further comprises a cam arm coupled to said rotatable flip guide, wherein when said carrier unit slides along said guide rail said cam arm contacts said flip stop member causing said cam arm and rotatable flip guide to rotate thereby reorienting the media located in said carrier unit.

12. A device according to claim 11 further comprising a biasing member coupled to and exerting a force on said cam arm for assisting in rotation of said cam arm.

13. A device according to claim 10 further comprising a biasing member coupled to and exerting a force on said rotatable flip guide for assisting in rotation of said rotatable flip guide.

14. A device according to claim 10 further comprising motor driven means coupled to said carrier unit for moving the unit in the first and opposed directions.

15. A device according to claim 10, wherein said carrier unit further comprises two flip guides for holding the media.

16. A device according to claim 10, wherein said carrier unit further comprises a shaft connected to said flip guide for rotating the flip guide and an adjustable friction means connected to said shaft to dampen oscillations in said carrier unit.

17. A device according to claim 10 further comprising an actuator adjacent to said guide rail for placing said flip stop member in either the extended position or the retracted position.

18. A device according to claim 17, wherein said actuator is connected to said frame and said frame is slidably connected to said flip stop member, such that when said carrier unit contacts said actuator, said frame slides relative to said flip stop member thereby placing said flip stop member into a retracted position.

19. A device for use with a printer for reorienting media used by the printer, comprising:

a frame comprising at least one guide rail extending relative to a defined media path of a printer;

a carrier unit slidably coupled to said guide rail for transporting the media in a first direction and in an opposite direction along said guide rail;

at least one rotatable flip guide coupled to said carrier unit for holding the media;

a pair of flip stop members spaced apart from each other, wherein said flip stop members are locatable in both extended and retracted positions, wherein one of said flip stop members is in an extended position for interacting with said rotatable flip guide and the other of said flip stop members is in a retracted position to avoid interaction with said rotatable flip guide, wherein when said carrier unit slides along said guide rail, said flip stop member passively interacts with said rotatable flip guide causing said rotatable flip guide to rotate thereby reorienting the media located in said carrier unit.

20. A device according to claim 19 further comprising an actuator adjacent said guide rail for placing said flip stop members in either the extended position or the retracted position.

21. A device according to claim 20, wherein said actuator is connected to said frame and said frame is slidably connected to said flip stop members, such that when said carrier unit contacts said actuator, said frame slides relative to said flip stop members to place one of said flip stop members in an extended position and the other of said flip stop members in a retracted position.

22. A device according to claim 19, wherein said carrier unit further comprises a cam arm coupled to said rotatable flip guide, wherein when said carrier unit slides along said guide rail said cam arm contacts said flip stop member causing said cam arm and rotatable flip guide to rotate thereby reorienting the media located in said carrier unit.

23. A device according to claim 19 further comprising a biasing member coupled to and exerting a force on said rotatable flip guide for assisting in rotation of said rotatable flip guide.

24. A device for use with a printer for reorienting media used by the printer, comprising:

a frame comprising at least one guide rail extending relative to a defined media path of a printer;

a carrier unit slidably coupled to said guide rail for transporting the media in a first direction and in an opposite direction along said guide rail;

at least one flip stop member adjacent said guide rail;

a cam arm;

two rotatable flip guides for holding the media, wherein one of said flip guides is an inner flip guide coupled to said cam arm, and the other flip guide is an outer flip guide coupled to a shaft;

wherein when said carrier unit slides along said guide rail said cam arm contacts said flip stop member causing said cam arm and rotatable flip guides to rotate thereby reorienting the media located in said carrier unit.

25. A device according to claim 24 further comprising a biasing member coupled to and exerting a force on said rotatable flip guide for assisting in rotation of said rotatable flip guide.

26. A device according to claim 24 further comprising:

a pair of flip stop members spaced apart from each other, wherein said flip stop members are locatable in both extended and retracted positions, wherein one of said flip stop members is in an extended position for interacting with said rotatable flip guides and the other of said flip stop members is in a refracted position to avoid interaction with said rotatable flip guides, wherein when said carrier unit slides along said guide rail, said flip stop member passively interacts with said rotatable flip guide causing said rotatable flip guide to rotate thereby reorienting the media located in said carrier unit.

27. A device according to claim 26 further comprising an actuator adjacent said guide rail for placing said flip stop members in either the extended position or the retracted position.

28. A device for use with a printer for reorienting media used by the printer, comprising:

a frame comprising at least one guide rail extending relative to a defined media path of a printer;

a carrier unit slidably coupled to said guide rail for transporting the media in a first direction and in an opposite direction alone said guide rail;

at least one rotatable flip guide coupled to said carrier unit for holding the media; and at least one flip stop member adjacent said guide rail, wherein when said carrier unit slides along said guide rail, said flip stop member passively interacts with said rotatable flip guide causing said rotatable flip guide to rotate thereby reorienting the media located in said carrier unit, wherein said frame further comprises a guide channel extending relative to the defined media path of a printer and substantially parallel with said guide rail, and said carrier unit further comprises an azimuth adjuster locatable in said guide channel to adjust the azimuth of said rotatable flip guide as it slides along said guide rail.

29. A device for use with a printer for reorienting media used by the printer, comprising:

a frame comprising at least one guide rail extending relative to a defined media path of a printer;

a carrier unit slidably coupled to said guide rail for transporting the media in a first direction and in an opposite direction along said guide rail;

at least one rotatable flip guide coupled to said carrier unit for holding the media; and at least two rotatable flip guides for holding the media, wherein each flip guide comprises a first elongated side frame member and a second elongated side frame member that are spaced apart to define a media-retaining channel there between, the first side frame member having an inner edge with a substantially concave central portion, and the second side frame member having an inner edge with a substantially convex central portion for gripping the media with the media-retaining channels, wherein when said carrier unit slides along said guide rail, said flip stop member passively interacts with said rotatable flip guide causing said rotatable flip guide to rotate thereby reorienting the media located in said carrier unit.

30. A device for use with a printer for reorienting media used by the printer, comprising:

a frame comprising at least one guide rail extending relative to a defined media path of a printer;

a carrier unit slidably coupled to said guide rail for transporting the media in a first direction and in an opposite direction along said guide rail;

at least one rotatable flip guide coupled to said carrier unit for holding the media; and a pair flip stop members adjacent said guide rail spaced apart from each other, wherein said flip stop members are locatable in both extended and retracted positions, wherein one of said flip stop members is in an extended position for interacting with said rotatable flip guide and the other of said flip stop members is in a retracted position to avoid interacting with said rotatable flip guide as said carrier unit slides along said guide rail, and wherein when said carrier unit slides along said guide rail, said carrier unit contacts said flip stop member located in the extended position causing said rotatable flip guide to rotate thereby reorienting the media.

31. A device according to claim 30 further comprising an actuator adjacent said guide rail for placing said flip stop members in either the extended position or the retracted position, wherein said actuator is connected to said frame and said frame is slidably connected to said flip stop members, such that when said carrier unit contacts said actuator, said frame slides relative to said flip stop members to place one of said flip stop members in an extended position and the other of said flip stop members in a retracted position.

* * * * *

UNITED STATES PATENT AND TRADEMARK OFFICE

CERTIFICATE OF CORRECTION

PATENT NO. : 7,063,013 B2
APPLICATION NO. : 10/807657
DATED : June 20, 2006
INVENTOR(S) : Jones et al.

It is certified that error appears in the above-identified patent and that said Letters Patent is hereby corrected as shown below:

Column 13,
Line 14, “alone” should read --along--.

Column 14,
Line 4, “channels” should read --channel--.

Signed and Sealed this

Thirtieth Day of January, 2007

JON W. DUDAS
*Director of the United States Patent and Trademark Office*